US006582043B2

(12) United States Patent
Ishizaki

(10) Patent No.: US 6,582,043 B2
(45) Date of Patent: Jun. 24, 2003

(54) DRIVING DEVICE AND DRIVING METHOD FOR INK JET PRINTING HEAD

(75) Inventor: Sunao Ishizaki, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/809,186

(22) Filed: Mar. 16, 2001

(65) Prior Publication Data

US 2001/0026292 A1 Oct. 4, 2001

(30) Foreign Application Priority Data

Mar. 17, 2000 (JP) ..... 2000-081773

(51) Int. Cl.[7] ..... B41J 29/38
(52) U.S. Cl. ..... 347/12
(58) Field of Search ..... 347/5, 9, 10, 11, 347/12, 15, 40, 68, 69, 70, 71, 72; 310/317; 330/174, 253

(56) References Cited

U.S. PATENT DOCUMENTS

| | | | | | |
|---|---|---|---|---|---|
| 3,739,293 | A | * | 6/1973 | Saari | 330/260 |
| 3,956,645 | A | * | 5/1976 | Boer | 327/322 |
| 3,968,450 | A | * | 7/1976 | Suzuki et al. | 330/264 |
| 4,091,338 | A | * | 5/1978 | Morihisa | 331/116 FE |
| 4,193,040 | A | * | 3/1980 | Weissman | 330/293 |
| 4,243,918 | A | * | 1/1981 | Meise | 315/389 |
| 4,717,927 | A | * | 1/1988 | Sato | 347/10 |
| 5,162,666 | A | * | 11/1992 | Tran | 327/408 |
| 5,552,809 | A | * | 9/1996 | Hosono et al. | 347/10 |
| 5,980,015 | A | * | 11/1999 | Saruta | 347/15 |
| 6,068,360 | A | * | 5/2000 | Hiwada | 347/14 |
| 6,243,109 | B1 | * | 6/2001 | Ishinaga et al. | 347/3 |
| 6,334,668 | B1 | * | 1/2002 | Isamoto | 347/57 |

FOREIGN PATENT DOCUMENTS

| | | |
|---|---|---|
| JP | 9-11457 | 1/1997 |
| JP | 9-174883 | 7/1997 |

OTHER PUBLICATIONS

Theodore F. Bogart, Jr., Electronic Devices and Circuits, 1986, Merrill Publishing Company, p. 680–681.*

* cited by examiner

*Primary Examiner*—Lamson Nguyen
*Assistant Examiner*—Blaise Mouttet
(74) *Attorney, Agent, or Firm*—Young & Thompson

(57) ABSTRACT

A driving device for driving an ink jet printing head having N (N=1, 2, 3, . . . ) nozzles includes a waveform generation circuit, three voltage amplification circuits, N multiplexers, and N current amplification circuits. The waveform generation circuit generates three waveforms for three driving signals VD1, VD2 and VD3 corresponding to ink drop sizes "large", "middle" and "small". The three voltage amplification circuits amplify the voltage levels of the three waveforms respectively and thereby outputs the driving signals VD1, VD2 and VD3. Each of the N multiplexers corresponding to the N nozzles selectively transmits zero or one of the driving signals VD1, VD2 and VD3 supplied from the voltage amplification circuits. Each of the N current amplification circuits corresponding to the N multiplexers amplifies the current level of the driving signal that has passed the corresponding multiplexer and thereby supplies the current-amplified driving signal to a corresponding piezoelectric actuator. The current amplification circuit is designed to have high input impedance, and the voltage amplification circuit is provided with an impedance conversion circuit and a feedback circuit for reducing its output impedance. By such composition of the driving device, precise and distortion-free driving signals can be supplied to the piezoelectric actuators and thereby high quality printing can be realized even when the frequency of the driving signal is high and even when a plurality of piezoelectric actuators of high load capacitance have to be driven.

12 Claims, 15 Drawing Sheets

FIG. 6A

VD1

| | n | $T_{1n}$ [μ sec] | $V_{1n}$ [v] |
|---|---|---|---|
| VD1 | 1 | 0.0 | 12.0 |
| | 2 | 4.0 | 7.2 |
| | 3 | 5.2 | 7.2 |
| | 4 | 14.8 | 31.0 |
| | 5 | 31.2 | 31.0 |
| | 6 | 77.2 | 12.0 |

FIG. 6B

VD2

| | n | $T_{2n}$ [μ sec] | $V_{2n}$ [v] |
|---|---|---|---|
| VD2 | 1 | 0.0 | 12.0 |
| | 2 | 3.4 | 4.8 |
| | 3 | 5.0 | 4.8 |
| | 4 | 8.0 | 13.4 |
| | 5 | 25.2 | 13.4 |
| | 6 | 30.4 | 12.0 |

FIG. 6C

VD3

| | n | $T_{3n}$ [μ sec] | $V_{3n}$ [v] |
|---|---|---|---|
| VD3 | 1 | 0.0 | 12.0 |
| | 2 | 2.0 | 4.2 |
| | 3 | 2.7 | 4.2 |
| | 4 | 9.0 | 10.3 |
| | 5 | 9.5 | 10.3 |
| | 6 | 11.0 | 4.2 |
| | 7 | 12.6 | 4.2 |
| | 8 | 14.1 | 12.0 |

DRIVING DEVICE AND DRIVING METHOD FOR INK JET PRINTING HEAD

BACKGROUND OF THE INVENTION

The present invention relates to a driving device and a driving method for an ink jet printing head which conducts printing by discharging ink drops from nozzles by changing the volumes of pressure generation chambers filled with ink according to driving signals which are supplied to piezoelectric actuators etc., and in particular, to a driving device and a driving method for an ink jet printing head that improves the expressiveness of gradation and halftones in print images by changing the size of ink dots which are formed on paper etc. by varying the ink drip size based on print data indicating halftones.

DESCRIPTION OF THE RELATED ART

Printing of halftone images on paper etc. has been conducted generally by binary image printing by use of image processing techniques such as the "dot area modulation method" and the "screened half tone (screening)". However, image printing of photographic-quality is being required in recent years and thereby printing by use of ink drop size modulation techniques is being required of ink jet printing heads.

A driving device for an ink jet printing head for meeting the request has been disclosed in Japanese Patent Application Laid-Open No.HEI9-11457 (hereafter, referred to as "document No.1"), in which two or more driving signals for the discharge of ink drops of different sizes are prepared, and the driving signals are selectively used based on image data.

FIG. 1 is a block diagram showing an example of a conventional ink jet printing head driving device for implementing the ink drop size modulation technique disclosed in the document No.1. The ink jet printing head driving device shown in FIG. 1 includes a common waveform generation circuit 101, an image memory 131, a data transmission circuit 132, a data reception circuit 143, a decoder 142, a level conversion circuit 141 and multiplexers 121-1~**121-*n*. The multiplexers 121-1~121-*n* are provided corresponding to piezoelectric actuators 123-1~123-*n* of the ink jet printing head. The common waveform generation circuit 101 includes a waveform generation circuit 111 and two or more voltage/current amplification circuits 112. In the example of FIG. 1, the common waveform generation circuit 101 includes three voltage/current amplification circuits 112A~112C. Each multiplexer 121-*k* ($1 \leqq k \leqq n$) which is composed of transfer gates selects (zero or) one of the voltage/current amplification circuits 112A~112C according to image data (print data) indicating a halftone, and a driving signal (VD1, VD2 or VD3) that is supplied from the selected voltage/current amplification circuit (112A, 112B or 112C) is transmitted by the multiplexer 121-*k* and is applied to a corresponding piezoelectric actuator 123-*k*** ($1 \leqq k \leqq n$), thereby printing of halftone images is conducted.

However, in the technique of the document No. 1, each voltage/current amplification circuit 112 (112A, 112B, 112C) of the common waveform generation circuit 101 is designed to drive a plurality of piezoelectric actuators 123-1~**123-*n* through the multiplexers 121-1~121-*n*, thereby waveform distortion of the driving signal occurs considerably between the voltage/current amplification circuit 112 (112A, 112B, 112C) and the piezoelectric actuators 123 (123-1~123-*n*) due to wire resistance and inductance. Further, the distortion of the driving signal varies depending on the number of piezoelectric actuators 123** that are driven simultaneously.

The above problems come up since a driving signal of a very high slew rate (dV/dt) has to be supplied to the piezoelectric actuator 123 which is a relatively large capacitive load. The very high slew rate of the driving signal is necessary for the formation and discharge of minute ink drops of approximately 2 pl (picoliter) which is required for high quality printing by means of the ink drop size modulation.

If we assume that the capacitance of a piezoelectric actuator 123 is $C_0$ (pF) and the number of driven piezoelectric actuators 123 is n, the load on the voltage/current amplification circuit 112 becomes $n \times C_0$. In a typical case where the number n is 300 and the capacitance $C_0$ is 3000 (pF), the load on the voltage/current amplification circuit 112 becomes $n \times C_0 = 0.9$ ($\mu$F). In order to realize the discharge of the picoliter ink drops, application of high-frequency voltage between the voltage/current amplification circuit 112 and the piezoelectric actuators 123 is required as a matter of course, therefore, considerable signal distortion is caused due to the wire resistance and inductance between the voltage/current amplification circuit 112 and the piezoelectric actuators 123. Further, the signal distortion varies depending on the number of simultaneously driven piezoelectric actuators 123 as mentioned above. Therefore, the sizes of discharged ink drops and printed ink dots are necessitated to vary and fluctuate.

For the printing of characters or letters, the ink jet printing head is required to discharge ink drops of large sizes. In such cases, a driving signal (waveform) having a large voltage variation has to be applied to each piezoelectric actuator 123. When the voltage of the driving signal changes from $V_0$ (V) to $V_1$ (V), heat emission P (W) of the voltage/current amplification circuit 112 is calculated as: $(1/2) \times n \times C_0 \times (V_1^2 - V_0^2)$. Therefore, the heat emission of the voltage/current amplification circuit 112 increases as the voltage variation $(V_1 - V_0)$ of the driving waveform gets larger.

The heat emission also changes proportionally to the number of simultaneously driven piezoelectric actuators 123, therefore, the heat emission of the voltage/current amplification circuit 112 further increases when the number of nozzles (that is, the number of piezoelectric actuators 123) of the ink jet printing head is set larger in order to realize high speed printing.

When the multiplexers 121-1~**121-*n* are implemented as an IC, each multiplexer 121 (121-1~121-*n*) is generally implemented as transfer gates each of which includes an N-MOSFET and a P-MOSFET. Therefore, when each multiplexer 121 includes three transfer gates as the example of FIG. 1, three N-MOSFETs and three P-MOSFETs become necessary in a multiplexer 121. Current for driving the piezoelectric actuators 123 has to be passed through each MOSFET, therefore, channel resistance of each MOSFET has to be set as small as possible in order to reduce heat emission of the multiplexer 121**. However, in order to set the channel resistance small, chip size of the IC is necessitated to be large, and thus high integration of the IC becomes difficult.

A driving device for an ink jet printing head designed for eliminating the heat emission problem of the common waveform generation circuit and the waveform distortion of the driving signal supplied to the piezoelectric actuators has been disclosed in Japanese Patent Application Laid-Open No.HEI9-174883 (hereafter, referred to as "document No.2").

FIG. 2 is a block diagram showing an example of a conventional ink jet printing head driving device which implements the techniques disclosed in the document No.2. In the ink jet printing head driving device of FIG. 2, each multiplexer (221-1~221-*n*) is provided with a corresponding voltage amplification circuit (212-1~212-*n*) before itself and a corresponding current amplification circuit (222-1~222-*n*) after itself.

By such composition of the ink jet printing head driving device for driving piezoelectric actuators 223-1~223-*n*, the heat emission problem of the common waveform generation circuit 201 and the waveform distortion of the driving signals supplied to the piezoelectric actuators 223-1~223-*n* are avoided.

However, considering the voltage amplification factor required of the voltage amplification circuit (212-1~212-*n*) amplifying the driving waveforms, it is preferable that the voltage amplification circuit (212-1~212-*n*) should be composed of a negative feedback amplification circuit. Voltage that has to be applied to the piezoelectric actuators 223-1~223-*n* is on the order of 10V, therefore, each voltage amplification circuit (212-1~212-*n*) has to be composed of parts withstanding such high voltage. If a plurality of such high-voltage-resistant voltage amplification circuits 212-1~212-*n* are integrated onto an IC, circuit scale (chip size) of the IC is necessitated to be too large and the degree of integration of the IC is necessitated to be very low.

Further, when the circuit shown in FIG. 2 is integrated onto an IC, circuits having high voltage amplification factors have to be packed close to each other, thereby current crosstalk between the voltage amplification circuits 212-1~212-*n* is caused.

Further, such a circuit having a high voltage amplification factor tends to become unstable by heat. If the heat-emitting current amplification circuits 222-1~222-*n* are closely packed in the IC, the operation of the voltage amplification circuits 212-1~212-*n* tends to be unstable due to the heat emission of the closely packed current amplification circuits 222-1~222-*n*.

FIG. 3A is a circuit diagram showing a first example of the composition of the current amplification circuit 222 (222-1~222-*n*) which has been disclosed in the document No.2. The current amplification circuit 222 shown in FIG. 3A has emitter follower structure by use of an NPN transistor Q202 and a PNP transistor Q203. However, such circuit composition involves the following problems or drawbacks.

First, the current amplification circuit 222 of FIG. 3A is composed of transistors, and thus the response of the current amplification circuit 222 to the driving signal having the relatively high slew rate becomes slow, therefore, there is a possibility of a cross current passing between the transistors Q202 and Q203. For the prevention of the cross current, a PNP transistor Q201 and an NPN transistor Q204 have to be added as shown in FIG. 3A.

Second, in the circuit composition of FIG. 3A, no bias voltage is applied between the gates of the NPN transistor Q202 and the PNP transistor Q203, therefore, crossover distortion occurs due to voltage between the base and emitter of each transistor.

FIG. 3B is a circuit diagram showing a second example of the composition of the current amplification circuit 222 (222-1~222-*n*) which has been disclosed in the document No.2. The current amplification circuit 222 of FIG. 3B is composed of a P-MOSFET Q211, an N-MOSFET Q212 and operational amplifiers OP201 and OP202. The operational amplifiers OP201 and OP202 are provided as gate inputs to the P-MOSFET Q211 and the N-MOSFET Q212. However, it is evident that the voltage level of the driving signal inputted to the current amplification circuit 222 exceeds at least 30 V. Therefore, it is substantially impossible to implement an IC including the current amplification circuits 222 of FIG. 3B employing operational amplifiers withstanding such high voltage.

SUMMARY OF THE INVENTION

It is therefore the primary object of the present invention to provide a driving device and a driving method for an ink jet printing head, by which the waveform distortion of the driving signals supplied to the piezoelectric actuators of the ink jet printing head can be reduced even if the piezoelectric actuator is of large load capacitance, the heat emission of the voltage amplification circuits of the common waveform generation circuit can be reduced, and high circuit integration of the driving circuit can be realized.

In accordance with a first aspect of the present invention, there is provided a driving device for an ink jet printing head which is capable of discharging ink drops from its N (N=1, 2, 3, . . . ) nozzles by changing the volumes of pressure generation chambers filled with ink. The driving device comprises a waveform generation means, a voltage amplification means, N selective transmission means, and N current amplification means. The waveform generation means generates a waveform for a driving signal. The voltage amplification means amplifies the voltage level of the waveform generated by the waveform generation means and thereby outputs the driving signal. The N selective transmission means are provided corresponding to the N nozzles. Each of the N selective transmission means selectively transmits the driving signal supplied from the voltage amplification means. The N current amplification means are provided corresponding to the N selective transmission means. Each of the N current amplification means amplifies the current level of the driving signal that has passed the corresponding selective transmission means and thereby supplies the current-amplified driving signal to a corresponding piezoelectric actuator so that the volume of a corresponding pressure generation chamber will be changed and the ink drop discharge will be conducted from a corresponding nozzle according to the current-amplified driving signal.

In accordance with a second aspect of the present invention, in the first aspect, the waveform generation means generates M (M=1, 2, 3, . . . ) types of waveforms, and the driving device includes M voltage amplification means corresponding to the M waveforms. Each of the M voltage amplification means amplifies the voltage level of corresponding one of the M waveforms and thereby outputs a driving signal. Each of the N selective transmission means transmits zero or one of the M driving signals outputted by the M voltage amplification means based on one or more selection control signals supplied thereto.

In accordance with a third aspect of the present invention, in the first aspect, the voltage amplification means is designed to have low output impedance.

In accordance with a fourth aspect of the present invention, in the third aspect, the voltage amplification means includes an impedance conversion circuit for reducing the output impedance of the voltage amplification means as its output stage for outputting the driving signal.

In accordance with a fifth aspect of the present invention, in the fourth aspect, the voltage amplification means further includes a feedback circuit and a differential amplification circuit. The feedback circuit returns part of the driving signal outputted by the voltage amplification means as a feedback voltage. The differential amplification circuit compares the waveform supplied from the waveform generation means with the feedback voltage supplied from the feedback circuit and amplifies the waveform according to the result of the comparison.

In accordance with a sixth aspect of the present invention, in the fifth aspect, the feedback circuit supplies the feedback voltage to the differential amplification circuit compensating for phase delay of the driving signal with respect to the waveform supplied to the differential amplification circuit.

In accordance with a seventh aspect of the present invention, in the fifth aspect, the voltage amplification means further includes a Miller integration circuit for further amplifying the waveform amplified by the differential amplification circuit.

In accordance with an eighth aspect of the present invention, in the seventh aspect, the voltage amplification means further includes a first constant-current circuit for supplying a constant current to the Miller integration circuit.

In accordance with a ninth aspect of the present invention, in the eighth aspect, the voltage amplification means further includes a first bias circuit for converting the waveform which has been further amplified by the Miller integration circuit to a bias voltage.

In accordance with a tenth aspect of the present invention, in the eighth aspect, the voltage amplification means further includes a buffer which is provided between the first constant-current circuit and the impedance conversion circuit so that the load on the Miller integration circuit will not be composed of a parallel connection of the load impedance of the first constant-current circuit and the capacitance of the impedance conversion circuit.

In accordance with an eleventh aspect of the present invention, in the fourth aspect, the impedance conversion circuit is designed to have single-ended push-pull (SEPP) structure.

In accordance with a twelfth aspect of the present invention, in the fourth aspect, the impedance conversion circuit includes: a first resistor and a second resistor which are connected in series; a first N-MOSFET whose drain is supplied with power supply voltage and whose source is connected to an end of the first resistor opposite to the second resistor; and a first P-MOSFET whose source is connected to and end of the second resistor opposite to the first resistor and whose drain is grounded. The output of the impedance conversion circuit is taken from wiring between the first resistor and the second resistor.

In accordance with a thirteenth aspect of the present invention, in the fifth aspect, the feedback circuit includes: a phase lead circuit which is composed of a third resistor and a first capacitor connected in parallel; and a fourth resistor which is connected to the output side of the phase lead circuit to be grounded.

In accordance with a fourteenth aspect of the present invention, in the fifth aspect, the differential amplification circuit includes: a first PNP transistor and a second PNP transistor having equivalent characteristics; a fifth resistor whose one end is connected to the emitters of the first PNP transistor and the second PNP transistor and whose other end is supplied with power supply voltage; and a sixth resistor whose one end is connected to the collector of the first PNP transistor and whose other end is connected to the collector of the second PNP transistor which is grounded. The waveform supplied from the waveform generation means is applied to the base of the first PNP transistor. The feedback voltage supplied from the feedback circuit is applied to the base of the second PNP transistor.

In accordance with a fifteenth aspect of the present invention, in the seventh aspect, the Miller integration circuit is implemented as a grounded-emitter circuit.

In accordance with a sixteenth aspect of the present invention, in the ninth aspect, the Miller integration circuit includes: a first NPN transistor whose base is supplied with the waveform amplified by the differential amplification circuit and whose collector is connected to the first bias circuit and whose emitter is grounded; and a second capacitor which is connected between the base and collector of the first NPN transistor.

In accordance with a seventeenth aspect of the present invention, in the eighth aspect, the first constant-current circuit is designed to have current mirror structure.

In accordance with an eighteenth aspect of the present invention, in the ninth aspect, the first constant-current circuit includes: a third PNP transistor and a fourth PNP transistor having equivalent characteristics and whose bases are connected together; a seventh resistor whose one end is connected to the emitter of the third PNP transistor and whose other end is supplied with power supply voltage; an eighth resistor whose one end is connected to the emitter of the fourth PNP transistor and whose other end is supplied with the power supply voltage; and a ninth resistor whose one end is connected to the collector of the third PNP transistor and whose other end is grounded. The collector of the third PNP transistor is connected to the bases of the third PNP transistor and the fourth PNP transistor. The collector of the fourth PNP transistor is connected to the Miller integration circuit via the first bias circuit.

In accordance with a nineteenth aspect of the present invention, in the ninth aspect, the first bias circuit includes: a second NPN transistor; a tenth resistor whose one end is connected to the first constant-current circuit and the collector of the second NPN transistor and whose other end is connected to the base of the second NPN transistor; and an eleventh resistor whose one end is connected to wiring between the tenth resistor and the base of the second NPN transistor and whose other end is connected to the emitter of the second NPN transistor and the Miller integration circuit.

In accordance with a twentieth aspect of the present invention, in the tenth aspect, the buffer is designed to have emitter follower structure.

In accordance with a twenty-first aspect of the present invention, in the nineteenth aspect, the buffer includes: a twelfth resistor and a thirteenth resistor which are connected in series; a third NPN transistor whose collector is supplied with power supply voltage and whose base is connected to the collector of the second NPN transistor of the first bias circuit and whose emitter is connected to an end of the twelfth resistor opposite to the thirteenth resistor; and a fifth PNP transistor whose emitter is connected to an end of the thirteenth resistor opposite to the twelfth resistor and whose base is connected to the emitter of the second NPN transistor of the first bias circuit and whose collector is grounded.

In accordance with a twenty-second aspect of the present invention, in the twenty-first aspect, the impedance conversion circuit includes: a first resistor and a second resistor which are connected in series; a first N-MOSFET whose drain is supplied with power supply voltage and whose gate is connected to the emitter of the third NPN transistor of the buffer and whose source is connected to an end of the first resistor opposite to the second resistor; and a first P-MOSFET whose source is connected to and end of the second resistor opposite to the first resistor and whose gate is connected to the emitter of the fifth PNP transistor of the buffer and whose drain is grounded. The output of the impedance conversion circuit is taken from wiring between the first resistor and the second resistor.

In accordance with a twenty-third aspect of the present invention, in the twenty-second aspect, the wiring between the first resistor and the second resistor of the impedance conversion circuit from which the output of the impedance conversion circuit is taken is connected to wiring between the twelfth resistor and the thirteenth resistor of the buffer.

In accordance with a twenty-fourth aspect of the present invention, in the thirteenth aspect, the output of the impedance conversion circuit is supplied to the phase lead circuit of the feedback circuit.

In accordance with a twenty-fifth aspect of the present invention, in the first aspect, the current amplification means includes: a second bias circuit for converting the driving signal that passed the corresponding selective transmission means to a bias voltage; and a first source follower having single-ended push-pull (SEPP) structure.

In accordance with a twenty-sixth aspect of the present invention, in the twenty-fifth aspect, the second bias circuit of the current amplification means includes: a fourteenth resistor and a fifteenth resistor which are connected in series and which receive the driving signal from the corresponding selective transmission means at wiring therebetween; a second constant-current circuit whose input terminal is supplied with power supply voltage and whose output terminal is connected to an end of the fourteenth resistor opposite to the fifteenth resistor; and a third constant-current circuit whose input terminal is connected to an end of the fifteenth resistor opposite to the fourteenth resistor and whose output terminal is grounded.

In accordance with a twenty-seventh aspect of the present invention, in the twenty-sixth aspect, the first source follower of the current amplification means includes: a second N-MOSFET whose drain is supplied with the power supply voltage and whose gate is connected to the output terminal of the second constant-current circuit; and a second P-MOSFET whose source is connected to the source of the second N-MOSFET and whose gate is connected to the input terminal of the third constant-current circuit and whose drain is grounded. The output of the current amplification means is taken from wiring between the sources of the second N-MOSFET and the second P-MOSFET.

In accordance with a twenty-eighth aspect of the present invention, in the twenty-fifth aspect, the first source follower of the current amplification means includes two MOSFETs, and the second bias circuit of the current amplification means includes two MOSFETs corresponding to the two MOSFETs of the first source follower. Each MOSFET of the first source follower has polarity that is opposite to that of the corresponding MOSFET of the second bias circuit.

In accordance with a twenty-ninth aspect of the present invention, in the twenty-fifth aspect, the second bias circuit of the current amplification means includes: a third P-MOSFET whose gate is supplied with the driving signal that passed the selective transmission means and whose drain is grounded; a third N-MOSFET whose gate is supplied with the driving signal that passed the selective transmission means and whose drain is supplied with power supply voltage; a sixteenth resistor whose one end is supplied with the power supply voltage and whose other end is connected to the source of the third P-MOSFET; and a seventeenth resistor whose one end is connected to the source of the third N-MOSFET and whose other end is grounded.

In accordance with a thirtieth aspect of the present invention, in the twenty-ninth aspect, the first source follower of the current amplification means includes: a fourth N-MOSFET whose drain is supplied with the power supply voltage and whose gate is connected to the source of the third P-MOSFET; and a fourth P-MOSFET whose source is connected to the source of the fourth N-MOSFET and whose gate is connected to the source of the third N-MOSFET and whose drain is grounded. The output of the current amplification means is taken from wiring between the sources of the fourth N-MOSFET and the fourth P-MOSFET.

In accordance with a thirty-first aspect of the present invention, in the first aspect, the current amplification means includes: a fourth constant-current circuit; and a second source follower having single-ended push-pull (SEPP) structure.

In accordance with a thirty-second aspect of the present invention, in the thirty-first aspect, the fourth constant-current circuit is designed to have current mirror structure.

In accordance with a thirty-third aspect of the present invention, in the thirty-second aspect, the current amplification means includes: a fifth P-MOSFET whose gate is supplied with the driving signal that passed the selective transmission means; an eighteenth resistor whose one end is supplied with power supply voltage and whose other end is connected to the source of the fifth P-MOSFET; a fifth N-MOSFET whose drain is supplied with the power supply voltage and whose gate is connected to the source of the fifth P-MOSFET; a sixth N-MOSFET whose drain is connected to the drain of the fifth P-MOSFET; a seventh N-MOSFET whose drain is connected to the source of the fifth N-MOSFET and whose gate is connected to the gate of the sixth N-MOSFET and the drain of the fifth P-MOSFET; a nineteenth resistor whose one end is connected to the source of the sixth N-MOSFET and whose other end is grounded; and a twentieth resistor whose one end is connected to the source of the seventh N-MOSFET and whose other end is grounded. The output of the current amplification means is taken from wiring between the source of the fifth N-MOSFET and the drain of the seventh N-MOSFET.

In accordance with a thirty-fourth aspect of the present invention, in the second aspect, the waveform generation means refers to variables which have preliminarily been stored in the driving device for specifying the M types of waveforms and thereby generates the M waveforms according to the variables.

In accordance with a thirty-fifth aspect of the present invention, in the second aspect, the selective transmission means includes M transfer gates each of which is composed of two MOSFETs.

In accordance with a thirty-sixth aspect of the present invention, there is provided a driving method for an ink jet printing head which is capable of discharging ink drops from its N (N=1, 2, 3, . . . ) nozzles by changing the volumes of pressure generation chambers filled with ink. The driving method comprises a waveform generation step, a voltage amplification step, a selective transmission step and a current amplification step. In the waveform generation step, a waveform for a driving signal is generated. In the voltage amplification step, the voltage level of the waveform generated in the waveform generation step is amplified and thereby the driving signal is obtained. In the selective transmission step, the driving signal obtained in the voltage amplification step is selectively transmitted by N selective transmission means corresponding to the N nozzles individually and simultaneously. In the current amplification step, the current level of each driving signal that passed each of the N selective transmission means in the selective transmission step is amplified by each of corresponding N current amplification means individually to be supplied to a corresponding piezoelectric actuator so that the volume of a corresponding pressure generation chamber will be changed and the ink drop discharge will be conducted from a corresponding nozzle according to the current-amplified driving signal.

In accordance with a thirty-seventh aspect of the present invention, in the thirty-sixth aspect, M (M=1, 2, 3, . . . ) types of waveforms are generated in the waveform generation step. The voltage level of each of the M waveforms is amplified individually and thereby M driving signals are obtained in the voltage amplification step. Zero or one of the M driving signals obtained in the voltage amplification step is selected and transmitted by each of the N selective transmission means individually and simultaneously based on one or more selection control signals supplied to each selective transmission means in the selective transmission step.

In accordance with a thirty-eighth aspect of the present invention, in the thirty-sixth aspect, a voltage amplification means having low output impedance is used for the voltage amplification step.

In accordance with a thirty-ninth aspect of the present invention, in the thirty-eighth aspect, the voltage amplification step is conducted employing an impedance conversion circuit for reducing output impedance as the output stage of the voltage amplification means.

In accordance with a fortieth aspect of the present invention, in the thirty-ninth aspect, the voltage amplification step is conducted further employing a feedback circuit and a differential amplification circuit. The feedback circuit returns part of the driving signal obtained in the voltage amplification step as a feedback voltage. The differential amplification circuit compares the waveform generated in the waveform generation step with the feedback voltage supplied from the feedback circuit and amplifies the waveform according to the result of the comparison.

In accordance with a forty-first aspect of the present invention, in the fortieth aspect, the feedback circuit supplies the feedback voltage to the differential amplification circuit compensating for phase delay of the driving signal with respect to the waveform supplied to the differential amplification circuit.

In accordance with a forty-second aspect of the present invention, in the fortieth aspect, the voltage amplification step is conducted further employing a Miller integration circuit for further amplifying the waveform amplified by the differential amplification circuit.

In accordance with a forty-third aspect of the present invention, in the forty-second aspect, the voltage amplification step is conducted further employing a first constant-current circuit for supplying a constant current to the Miller integration circuit.

In accordance with a forty-fourth aspect of the present invention, in the forty-third aspect, the voltage amplification step is conducted further employing a first bias circuit for converting the waveform which has been further amplified by the Miller integration circuit to a bias voltage.

In accordance with a forty-fifth aspect of the present invention, in the forty-third aspect, the voltage amplification step is conducted further employing a buffer which is provided between the first constant-current circuit and the impedance conversion circuit so that the load on the Miller integration circuit will not be composed of a parallel connection of the load impedance of the first constant-current circuit and the capacitance of the impedance conversion circuit.

In accordance with a forty-sixth aspect of the present invention, in the thirty-ninth aspect, the impedance conversion circuit is designed to have single-ended push-pull (SEPP) structure.

In accordance with a forty-seventh aspect of the present invention, in the thirty-ninth aspect, the impedance conversion circuit includes: a first resistor and a second resistor which are connected in series; a first N-MOSFET whose drain is supplied with power supply voltage and whose source is connected to an end of the first resistor opposite to the second resistor; and a first P-MOSFET whose source is connected to and end of the second resistor opposite to the first resistor and whose drain is grounded. The output of the impedance conversion circuit is taken from wiring between the first resistor and the second resistor.

In accordance with a forty-eighth aspect of the present invention, in the fortieth aspect, the feedback circuit includes: a phase lead circuit which is composed of a third resistor and a first capacitor connected in parallel; and a fourth resistor which is connected to the output side of the phase lead circuit to be grounded.

In accordance with a forty-ninth aspect of the present invention, in the fortieth aspect, the differential amplification circuit includes: a first PNP transistor and a second PNP transistor having equivalent characteristics; a fifth resistor whose one end is connected to the emitters of the first PNP transistor and the second PNP transistor and whose other end is supplied with power supply voltage; and a sixth resistor whose one end is connected to the collector of the first PNP transistor and whose other end is connected to the collector of the second PNP transistor which is grounded. The waveform generated in the waveform generation step is applied to the base of the first PNP transistor, The feedback voltage supplied from the feedback circuit is applied to the base of the second PNP transistor.

In accordance with a fiftieth aspect of the present invention, in the forty-second aspect, the Miller integration circuit is implemented as a grounded-emitter circuit.

In accordance with a fifty-first aspect of the present invention, in the forty-fourth aspect, the Miller integration circuit includes: a first NPN transistor whose base is supplied with the waveform amplified by the differential amplification circuit and whose collector is connected to the first bias circuit and whose emitter is grounded; and a second capacitor which is connected between the base and collector of the first NPN transistor.

In accordance with a fifty-second aspect of the present invention, in the forty-third aspect, the first constant-current circuit is designed to have current mirror structure.

In accordance with a fifty-third aspect of the present invention, in the forty-fourth aspect, the first constant-current circuit includes: a third PNP transistor and a fourth PNP transistor having equivalent characteristics and whose bases are connected together; a seventh resistor whose one end is connected to the emitter of the third PNP transistor and whose other end is supplied with power supply voltage; an eighth resistor whose one end is connected to the emitter of the fourth PNP transistor and whose other end is supplied with the power supply voltage; and a ninth resistor whose one end is connected to the collector of the third PNP transistor and whose other end is grounded. The collector of the third PNP transistor is connected to the bases of the third PNP transistor and the fourth PNP transistor. The collector of the fourth PNP transistor is connected to the Miller integration circuit via the first bias circuit.

In accordance with a fifty-fourth aspect of the present invention, in the forty-fourth aspect, the first bias circuit includes: a second NPN transistor; a tenth resistor whose one end is connected to the first constant-current circuit and the collector of the second NPN transistor and whose other end is connected to the base of the second NPN transistor; and an eleventh resistor whose one end is connected to wiring between the tenth resistor and the base of the second NPN transistor and whose other end is connected to the emitter of the second NPN transistor and the Miller integration circuit.

In accordance with a fifty-fifth aspect of the present invention, in the forty-fifth aspect, the buffer is designed to have emitter follower structure.

In accordance with a fifty-sixth aspect of the present invention, in the fifty-fourth aspect, the buffer includes: a twelfth resistor and a thirteenth resistor which are connected in series; a third NPN transistor whose collector is supplied with power supply voltage and whose base is connected to the collector of the second NPN transistor of the first bias circuit and whose emitter is connected to an end of the twelfth resistor opposite to the thirteenth resistor; and a fifth PNP transistor whose emitter is connected to an end of the thirteenth resistor opposite to the twelfth resistor and whose base is connected to the emitter of the second NPN transistor of the first bias circuit and whose collector is grounded.

In accordance with a fifty-seventh aspect of the present invention, in the fifty-sixth aspect, the impedance conversion circuit includes: a first resistor and a second resistor which are connected in series; a first N-MOSFET whose drain is supplied with power supply voltage and whose gate is connected to the emitter of the third NPN transistor of the buffer and whose source is connected to an end of the first resistor opposite to the second resistor; and a first P-MOSFET whose source is connected to and end of the second resistor opposite to the first resistor and whose gate is connected to the emitter of the fifth PNP transistor of the buffer and whose drain is grounded. The output of the impedance conversion circuit is taken from wiring between the first resistor and the second resistor.

In accordance with a fifty-eighth aspect of the present invention, in the fifty-seventh aspect, the wiring between the first resistor and the second resistor of the impedance conversion circuit from which the output of the impedance conversion circuit is taken is connected to wiring between the twelfth resistor and the thirteenth resistor of the buffer.

In accordance with a fifty-ninth aspect of the present invention, in the forty-eighth aspect, the output of the impedance conversion circuit is supplied to the phase lead circuit of the feedback circuit.

In accordance with a sixtieth aspect of the present invention, in the thirty-sixth aspect, the current amplification means which is used for the current amplification step includes: a second bias circuit for converting the driving signal that passed the corresponding selective transmission means in the selective transmission step to a bias voltage; and a first source follower having single-ended push-pull (SEPP) structure.

In accordance with a sixty-first aspect of the present invention, in the sixtieth aspect, the second bias circuit of the current amplification means includes: a fourteenth resistor and a fifteenth resistor which are connected in series and which receive the driving signal from the corresponding selective transmission means at wiring therebetween; a second constant-current circuit whose input terminal is supplied with power supply voltage and whose output terminal is connected to an end of the fourteenth resistor opposite to the fifteenth resistor; and a third constant-current circuit whose input terminal is connected to an end of the fifteenth resistor opposite to the fourteenth resistor and whose output terminal is grounded.

In accordance with a sixty-second aspect of the present invention, in the sixty-first aspect, the first source follower of the current amplification means includes: a second N-MOSFET whose drain is supplied with the power supply voltage and whose gate is connected to the output terminal of the second constant-current circuit; and a second P-MOSFET whose source is connected to the source of the second N-MOSFET and whose gate is connected to the input terminal of the third constant-current circuit and whose drain is grounded. The output of the current amplification means is taken from wiring between the sources of the second N-MOSFET and the second P-MOSFET.

In accordance with a sixty-third aspect of the present invention, in the sixtieth aspect, the first source follower of the current amplification means includes two MOSFETs, and the second bias circuit of the current amplification means includes two MOSFETs corresponding to the two MOSFETs of the first source follower. Each MOSFET of the first source follower has polarity that is opposite to that of the corresponding MOSFET of the second bias circuit.

In accordance with a sixty-fourth aspect of the present invention, in the sixtieth aspect, the second bias circuit of the current amplification means includes: a third P-MOSFET whose gate is supplied with the driving signal that passed the selective transmission means in the selective transmission step and whose drain is grounded; a third N-MOSFET whose gate is supplied with the driving signal that passed the selective transmission means in the selective transmission step and whose drain is supplied with power supply voltage; a sixteenth resistor whose one end is supplied with the power supply voltage and whose other end is connected to the source of the third P-MOSFET; and a seventeenth resistor whose one end is connected to the source of the third N-MOSFET and whose other end is grounded.

In accordance with a sixty-fifth aspect of the present invention, in the sixty-fourth aspect, the first source follower of the current amplification means includes: a fourth N-MOSFET whose drain is supplied with the power supply voltage and whose gate is connected to the source of the third P-MOSFET; and a fourth P-MOSFET whose source is connected to the source of the fourth N-MOSFET and whose gate is connected to the source of the third N-MOSFET and whose drain is grounded. The output of the current amplification means is taken from wiring between the sources of the fourth N-MOSFET and the fourth P-MOSFET.

In accordance with a sixty-sixth aspect of the present invention, in the thirty-sixth aspect, the current amplification means which is used for the current amplification step includes: a fourth constant-current circuit; and a second source follower having single-ended push-pull (SEPP) structure.

In accordance with a sixty-seventh aspect of the present invention, in the sixty-sixth aspect, the fourth constant-current circuit is designed to have current mirror structure.

In accordance with a sixty-eighth aspect of the present invention, in the sixty-seventh aspect, the current amplification means includes: a fifth P-MOSFET whose gate is supplied with the driving signal that passed the selective transmission means in the selective transmission step; an eighteenth resistor whose one end is supplied with power supply voltage and whose other end is connected to the source of the fifth P-MOSFET; a fifth N-MOSFET whose drain is supplied with the power supply voltage and whose gate is connected to the source of the fifth P-MOSFET; a sixth N-MOSFET whose drain is connected to the drain of the fifth P-MOSFET; a seventh N-MOSFET whose drain is connected to the source of the fifth N-MOSFET and whose gate is connected to the gate of the sixth N-MOSFET and the drain of the fifth P-MOSFET; a nineteenth resistor whose one end is connected to the source of the sixth N-MOSFET and whose other end is grounded; and a twentieth resistor whose one end is connected to the source of the seventh N-MOSFET and whose other end is grounded. The output of the current amplification means is taken from wiring between the source of the fifth N-MOSFET and the drain of the seventh N-MOSFET.

In accordance with a sixty-ninth aspect of the present invention, in the thirty-seventh aspect, in the waveform generation step, variables which have preliminarily been stored for specifying the M types of waveforms are referred to and thereby the M waveforms are generated according to the variables.

In accordance with a seventieth aspect of the present invention, in the thirty-seventh aspect, the selective transmission means which is used for the selective transmission step includes M transfer gates each of which is composed of two MOSFETs.

BRIEF DESCRIPTION OF THE DRAWINGS

The objects and features of the present invention will become more apparent from the consideration of the following detailed description taken in conjunction with the accompanying drawings, in which:

FIGS. 6A through 6C are tables indicating variables for specifying the driving signals VD1, VD2 and VD3;

DESCRIPTION OF THE PREFERRED EMBODIMENTS

Figure 1:
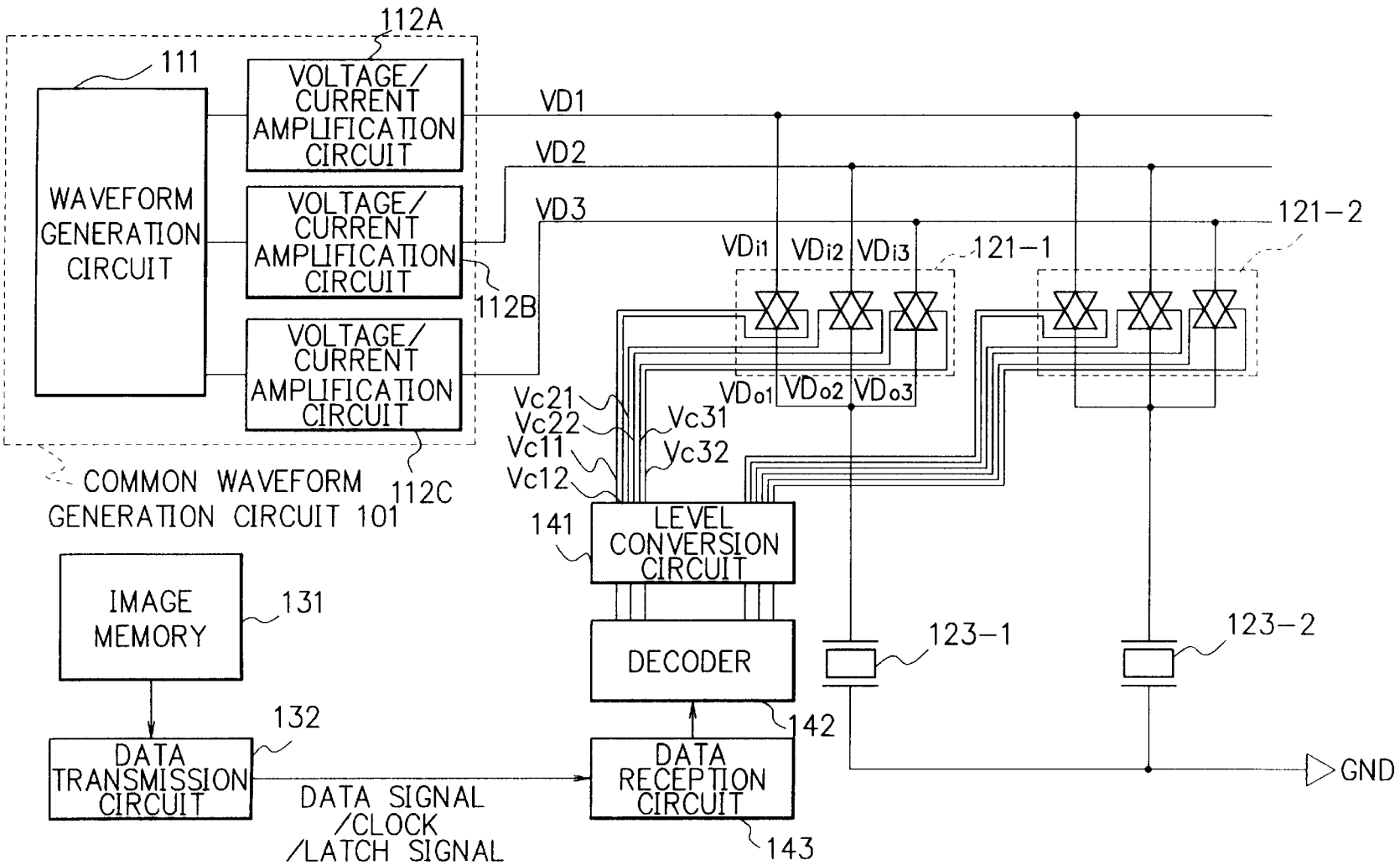
FIG. 1 (PRIOR ART)
FIG. 1 is a block diagram showing an example of a conventional ink jet printing head driving device for implementing the ink drop size modulation technique.
Figure 2:
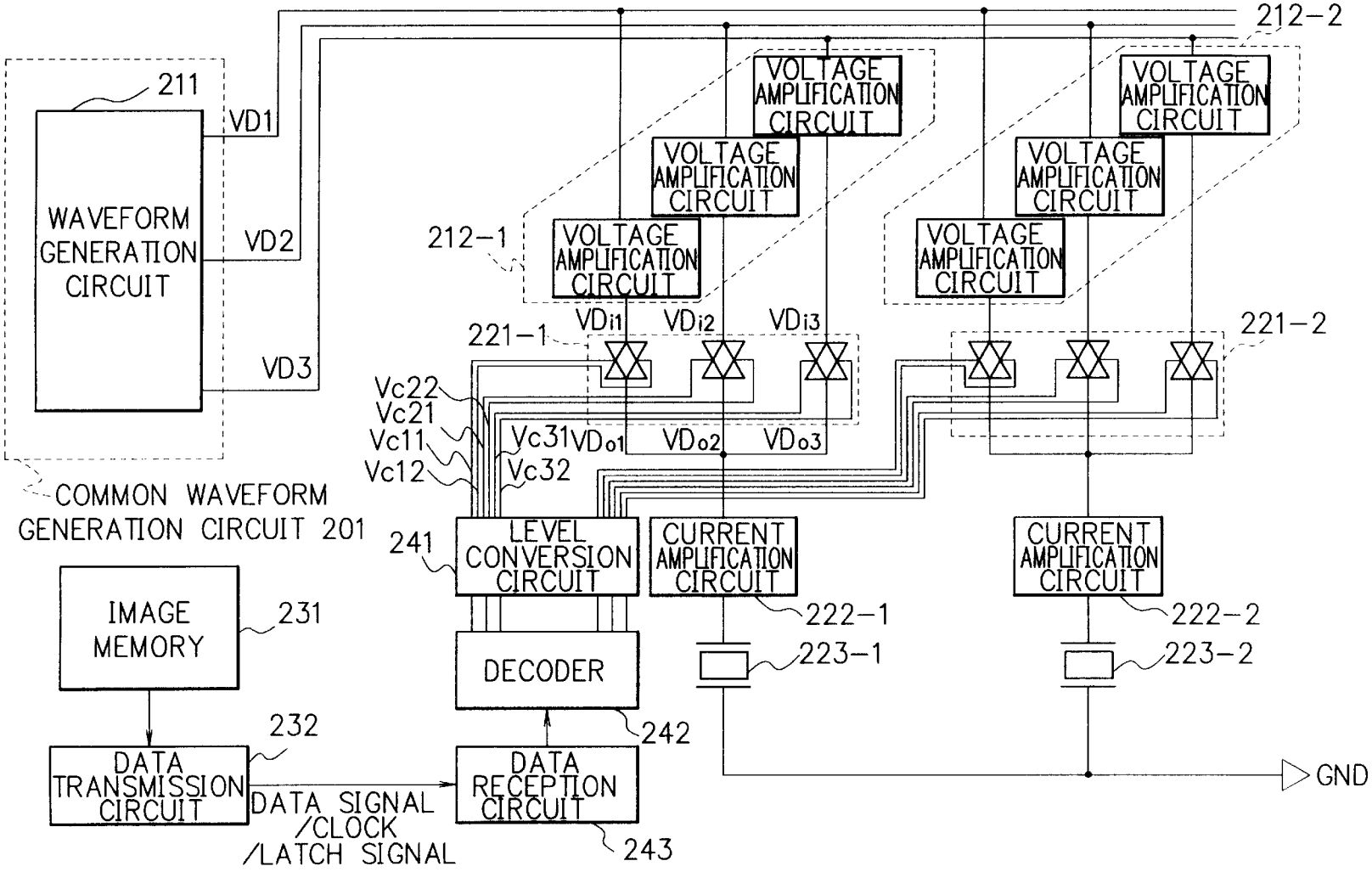
FIG. 2 (PRIOR ART)
FIG. 2 is a block diagram showing another example of a conventional ink jet printing head driving device which implements techniques disclosed in Japanese Patent Application Laid-Open No.HEI9-174883.
Figure 3A:
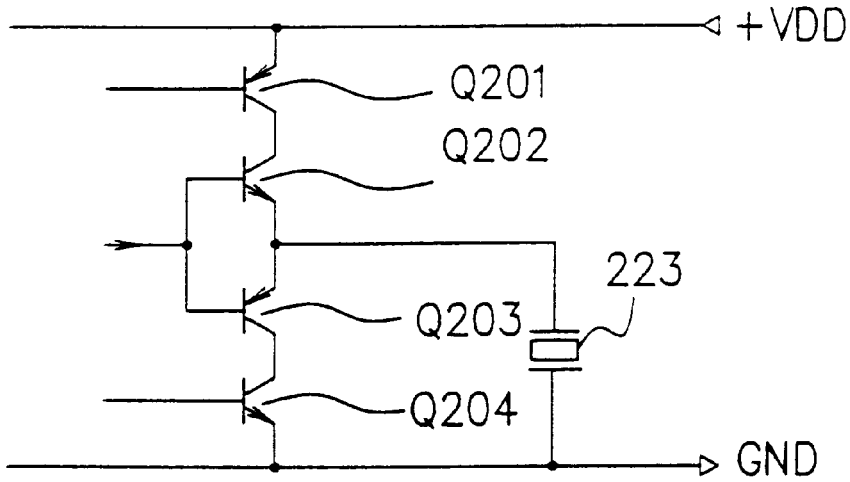
FIG. 3A (PRIOR ART)
FIG. 3A is a circuit diagram showing a first example of the composition of a current amplification circuit of the ink jet printing head driving device of FIG. 2 which has been disclosed in the above document.
Figure 3B:
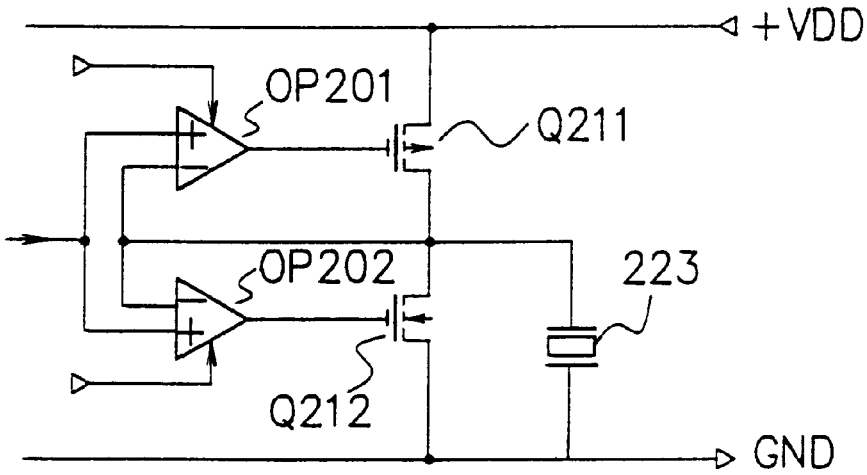
FIG. 3B (PRIOR ART)
FIG. 3B is a circuit diagram showing a second example of the composition of the current amplification circuit of the ink jet printing head driving device of FIG. 2 which has been disclosed in the above document.

Referring now to the drawings, a description will be given in detail of preferred embodiments in accordance with the present invention.

<<Preparation: Ink Jet Printing Head>>

Figure 4A:
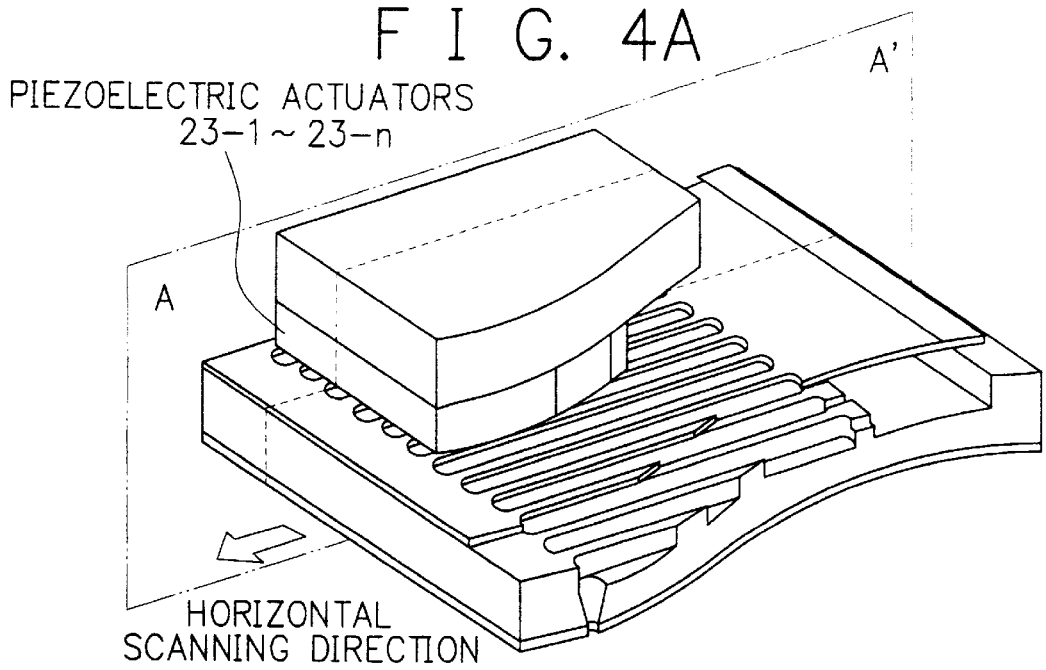
FIG. 4A is a partly broken perspective view showing the structure of an ink jet printing head which is driven by an ink jet printing head driving device in accordance with the present invention.
Figure 4B:
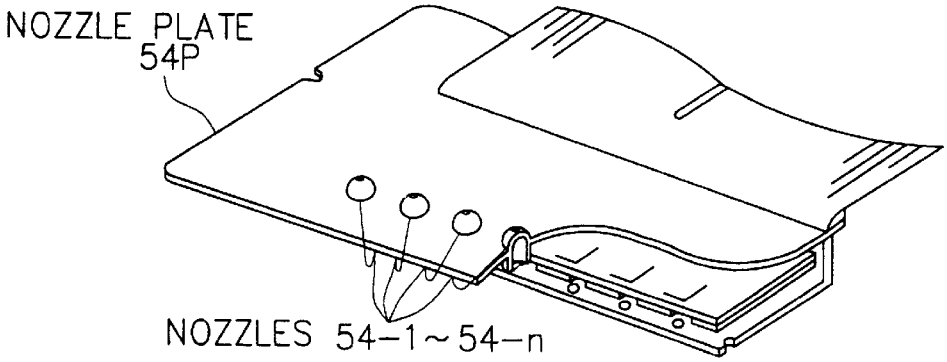
FIG. 4B is a partly broken perspective view showing nozzles and a nozzle plate of the ink jet printing head of FIG. 4A.
Figure 4C:
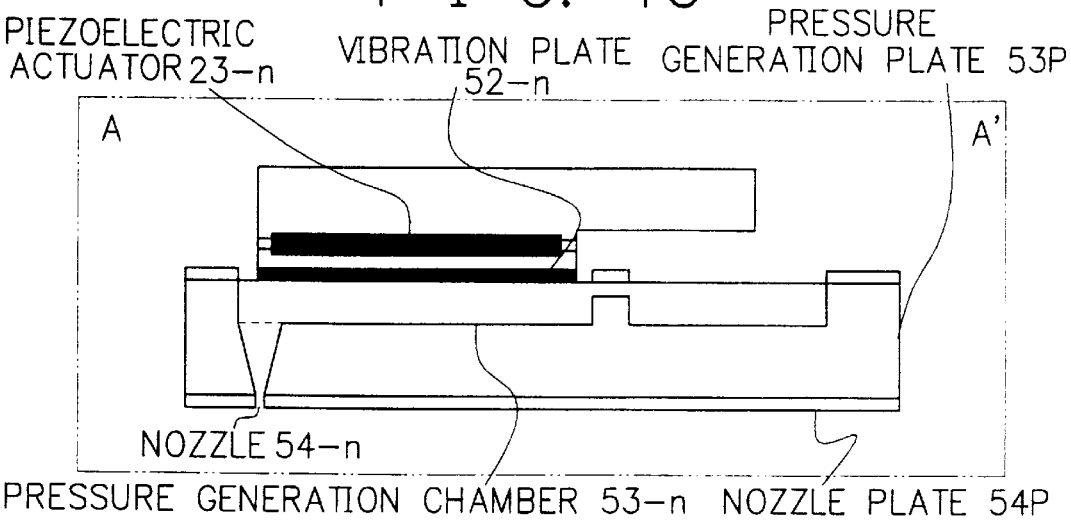
FIG. 4C is a cross sectional view of the ink jet printing head of FIG. 4A taken along the line A-A' shown in FIG. 4A.

FIG. 4A is a partly broken perspective view showing the structure of an ink jet printing head which is driven by an ink jet printing head driving device in accordance with the present invention. The ink jet printing head shown in FIG. 4A is a generally used ink jet printing head having conventional structure. FIG. 4B is a partly broken perspective view showing nozzles 54-1~54-*n* and a nozzle plate 54P of the ink jet printing head of FIG. 4A. FIG. 4C is a cross sectional view of the ink jet printing head of FIG. 4A taken along the line A-A' shown in FIG. 4A.

The ink jet printing head shown in FIGS. 4A through 4C has layered structure including a nozzle plate 54P, a pressure generation plate 53P, vibration plates 52-1~52-*n* and piezoelectric actuators 23-1~23-*n*. A plurality of nozzles 54-1~54-*n* are formed through the nozzle plate 54P. On the pressure generation plate 53P, pressure generation chambers 53-1~53-*n* are formed corresponding to the nozzles 54-1~54-*n*. Each vibration plate (52-1~52-*n*) is provided corresponding to each pressure generation chamber (53-1~53-*n*) so as to operate as a vibrating top plate of the pressure generation chamber. Each piezoelectric actuator (23-1~23-*n*) is bonded to each corresponding vibration plate (52-1~52-*n*).

In the ink jet printing head constructed as above, driving signals are selectively applied to the piezoelectric actuators 23-1~23-*n* based on dot information included in image data, thereby piezoelectric actuators **23-1~23-*n* receiving the driving signals deform corresponding vibration plates 52-1~52-*n*** according to the waveforms of the driving signals.

Such an ink jet printing head that changes the volumes of the pressure generation chambers **53-1~53-*n* filled with ink and thereby discharges ink drops from corresponding nozzles 54-1~54-*n*** are called "drop-on-demand multi-nozzle head".

For the driving of the piezoelectric actuators **23-1~23-*n*, two or more types of driving signals are prepared in order to implement the halftone printing of each dot. In the embodiments of the present invention, three types of driving signals are prepared as shown in FIGS. 5A through 6C, therefore, 4-step halftone printing including: large dot printing, middle dot printing, small dot printing and no dot printing, can be executed for each dot. Detailed explanation of FIGS. 5A through 6**C will be given later.

An ink jet printing head includes a plurality of nozzles **54-1 ~54-*n* and corresponding piezoelectric actuators 23-1~23-*n*. The number (n) of the nozzles 54-1~54-*n* (or piezoelectric actuators 23-1~23-*n*) is set to 256 (64×4 colors (CMYK), for example. Piezoelectric actuators corresponding to a color are aligned in a row in the vertical scanning direction. Incidentally, in the explanation of the present invention, the capacitance of each piezoelectric actuator (23-1~23-*n*) is assumed to be approximately 3000 pF, and each piezoelectric actuator (23-1~23-*n***) is assumed to have a maximum displacement of 0.2 μm. The ink jet printing head is assumed to conduct 64-dot printing for each color (cyan, magenta, yellow and black), for example.

<<Preparation: Driving Signals VD1, VD2 and VD3>>

In the 4-step halftone printing, the size of an ink drop discharged from a nozzle (**54-1~54-*n*) is selected from large, middle, small and zero. The large ink drop, the middle ink drop and the small ink drop will be assumed to have flying ink drop diameters of approximately 40 μm, 30 μm and 20 μm, respectively. The three types of driving signals which are applied to the piezoelectric actuators 23-1~23-*n* for the discharge of the large ink drop, the middle ink drop and the small ink drop will be called "driving signals VD1, VD2 and VD3". By use of the driving signals VD1, VD2 and VD3**, printing of characters, images, etc. can be executed by means of 4-step halftone printing for each dot.

Figure 5A:
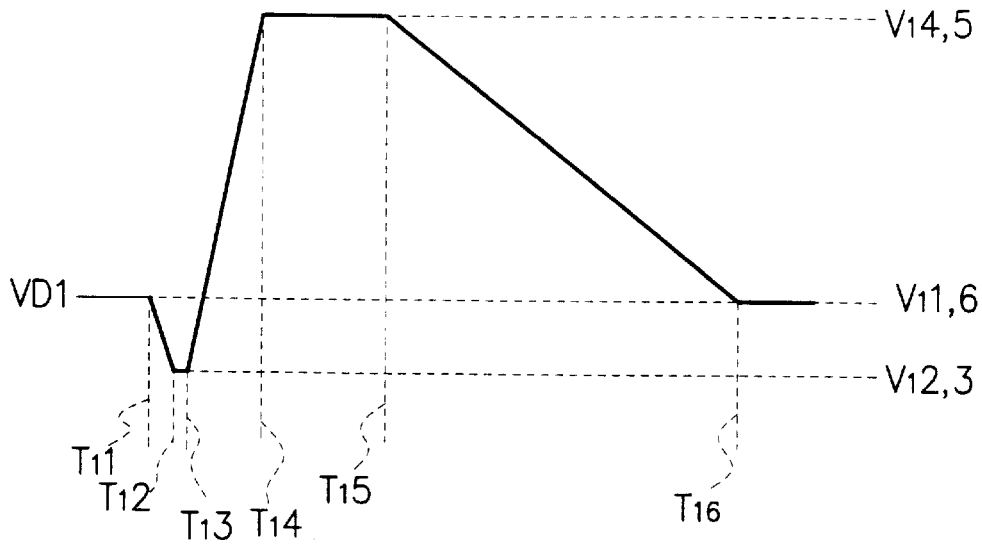
FIGS. 5A through 5C are waveform charts showing waveforms of driving signals VD1, VD2 and VD3 which are applied to piezoelectric actuators of the ink jet printing head.
Figure 5B:
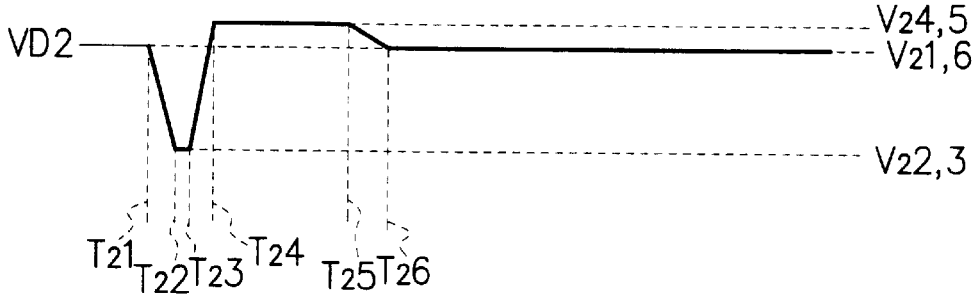
Figure 5C:
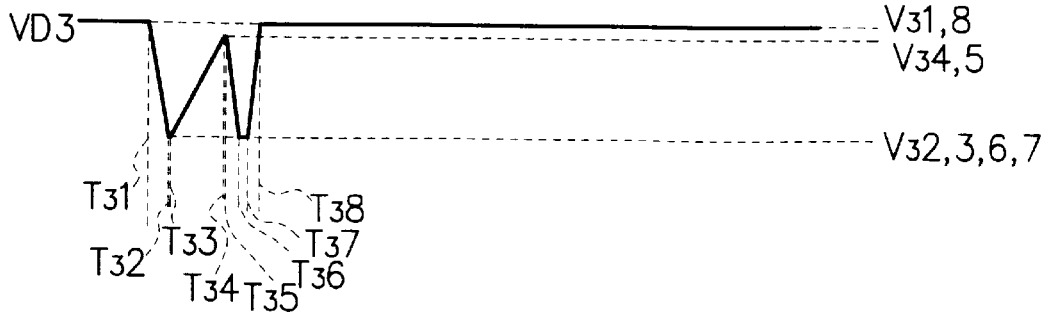

FIGS. 5A through 5C are waveform charts showing waveforms of the driving signals VD1, VD2 and VD3 which are applied to the piezoelectric actuators **23-1~23-*n*. The driving signals VD1, VD2 and VD3 shown in FIGS. 5A through 5**C are used in the embodiments for the discharge of the large ink drop, the middle ink drop and the small ink drop, respectively.

FIGS. 6A through 6C are tables indicating variables for specifying the driving signals VD1, VD2 and VD3. The variables shown in the tables of FIGS. 6A through 6C are stored in ROM etc. of the ink jet printing head driving device.

The piezoelectric actuator (**23-1~23-*n*) employed in the embodiments will be assumed to increase the volume of the corresponding pressure generation chamber (53-1~53-*n*) when being electrically discharged. On the other hand, when the piezoelectric actuator (23-1~23-*n*) is being charged, the volume of the corresponding pressure generation chamber (53-1~53-*n***) decreases.

Therefore, each of the driving signals VD1, VD2 and VD3 shown in FIGS. 5A through 6C is designed to first discharge electricity stored in the piezoelectric actuator so as to increase the volume of the corresponding pressure generation chamber (for pulling back the meniscus of ink in the nozzle) and thereafter charge the piezoelectric actuator so as to decrease the volume of the pressure generation chamber (for the discharge of an ink drop from the nozzle).

In the first stage ($T_1^1$~$T_1^3$, $T_2^1$~$T_2^3$, $T_3^1$~$T_3^3$) of each driving signal (VD1, VD2, VD3), voltage is decreased below 0 V so that the ink meniscuses which are protruding from the openings of the nozzles **54-1~54-*n* due to surface tension will be pulled back first. The first "pulling back operation" is conducted since ink drops of correct sizes can not be discharged if the ink drop discharge is executed with the ink meniscus protruding from the nozzle 54**.

The driving signal VD1 for the discharge of the large ink drop is designed so that a small amount of electrical charges will be discharged relatively slowly first and thereafter a large amount of electrical charges will be charged relatively slowly. On the other hand, the driving signal VD3 for the discharge of the small ink drop is designed so that a large amount of electrical charges will be discharged relatively rapidly first and thereafter a small amount of electrical charges will be charged relatively rapidly.

In the final stage of each driving signal (VD1, VD2, VD3), voltage is changed so as to stop the vibration of the vibration plates **52-1~52-*n***after the ink drop discharge.

Waveforms corresponding to the driving signals VD1, VD2 and VD3 are generated by a waveform generation circuit 11 of the ink jet printing head driving device by referring to the variables of FIGS. 6A through 6C, as will be explained later.

[Embodiment 1]

In the following, an ink jet printing head driving device and an ink jet printing head driving method in accordance with a first embodiment of the present invention will be explained in detail.

Figure 7:
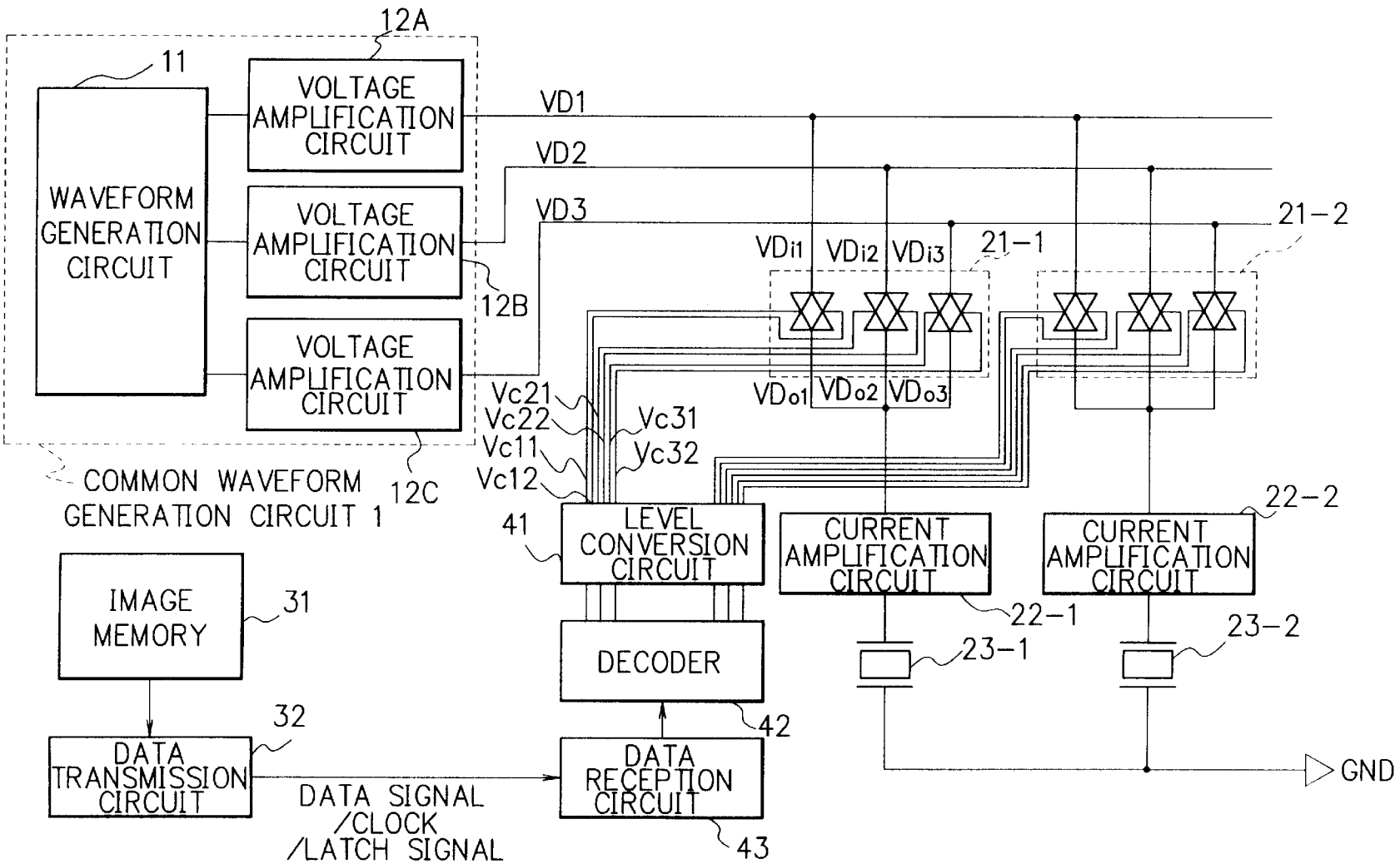
FIG. 7 is a block diagram showing an example of the composition of an ink jet printing head driving device in accordance with a first embodiment of the present invention.

FIG. 7 is a block diagram showing an example of the composition of the ink jet printing head driving device in accordance with the first embodiment of the present invention.

The ink jet printing head driving device shown in FIG. 7 includes: a common waveform generation circuit 1 for generating the three driving signals VD1, VD2 and VD3 simultaneously; multiplexers **21-1~21-*n*each of which selectively transmits one of the driving signals VD1, VD2 and VD3 outputted by the common waveform generation circuit 1; current amplification circuits 22-1~22-*n* each of which amplifies the current level of the driving signal that passed a corresponding multiplexer (21-1~21-*n*); and piezoelectric actuators 23-1~23-*n*each of which deforms a corresponding vibration plate (52-1~52-*n*) according to the driving signal whose current level has been amplified by a corresponding current amplification circuit (22-1~22-*n***).

The ink jet printing head driving device of FIG. 7 further includes: an image memory 31 for storing image data (the object of printing) in the form of parallel data; a data transmission circuit 32 for converting the parallel data to serial data (including a data signal, a clock signal and a latch signal) and transmitting the serial data; a data reception circuit 43 for receiving the serial data supplied from the data transmission circuit 32, converting the serial data to the original parallel data and outputting the parallel data; a decoder 42 for generating selection control signals Vc11, Vc12, Vc21, Vc22, Vc31 and Vc32 (for the selection of driving signals to be transmitted by the multiplexers **21-1~21-*n*) based on dot information included in the parallel data supplied from the data reception circuit 43; and a level conversion circuit 41 for converting the voltage levels of the selection control signals Vc11, Vc12, Vc21, Vc22, Vc31 and Vc32 generated by the decoder 42**.

<<Common Waveform Generation Circuit 1>>

The common waveform generation circuit 1 includes: a waveform generation circuit 11 for generating waveforms corresponding to the driving signals which have been explained referring to FIGS. 5A through 6C; and three voltage amplification circuits 12A, 12B and 12C for amplifying the voltage levels of the three waveforms generated by the waveform generation circuit 11.

The waveform generation circuit 11 refers to the variables shown in the tables of FIGS. 6A through 6C and thereby outputs three waveforms whose voltage levels change according to the variables. Incidentally, the voltage levels described in the tables of FIGS. 6A through 6C are those for driving the piezoelectric actuators 23-1~23-*n*, whereas the voltage levels of the waveforms which are actually generated by the waveform generation circuit 11 are approximately 2V. The voltage amplification circuits 12A, 12B and 12C are provided to the common waveform generation circuit 1 in order to convert the voltage levels of the waveforms (driving signals VD1, VD2 and VD3) to voltage levels suitable for driving the piezoelectric actuators 23-1~23-*n*.

Figure 8:
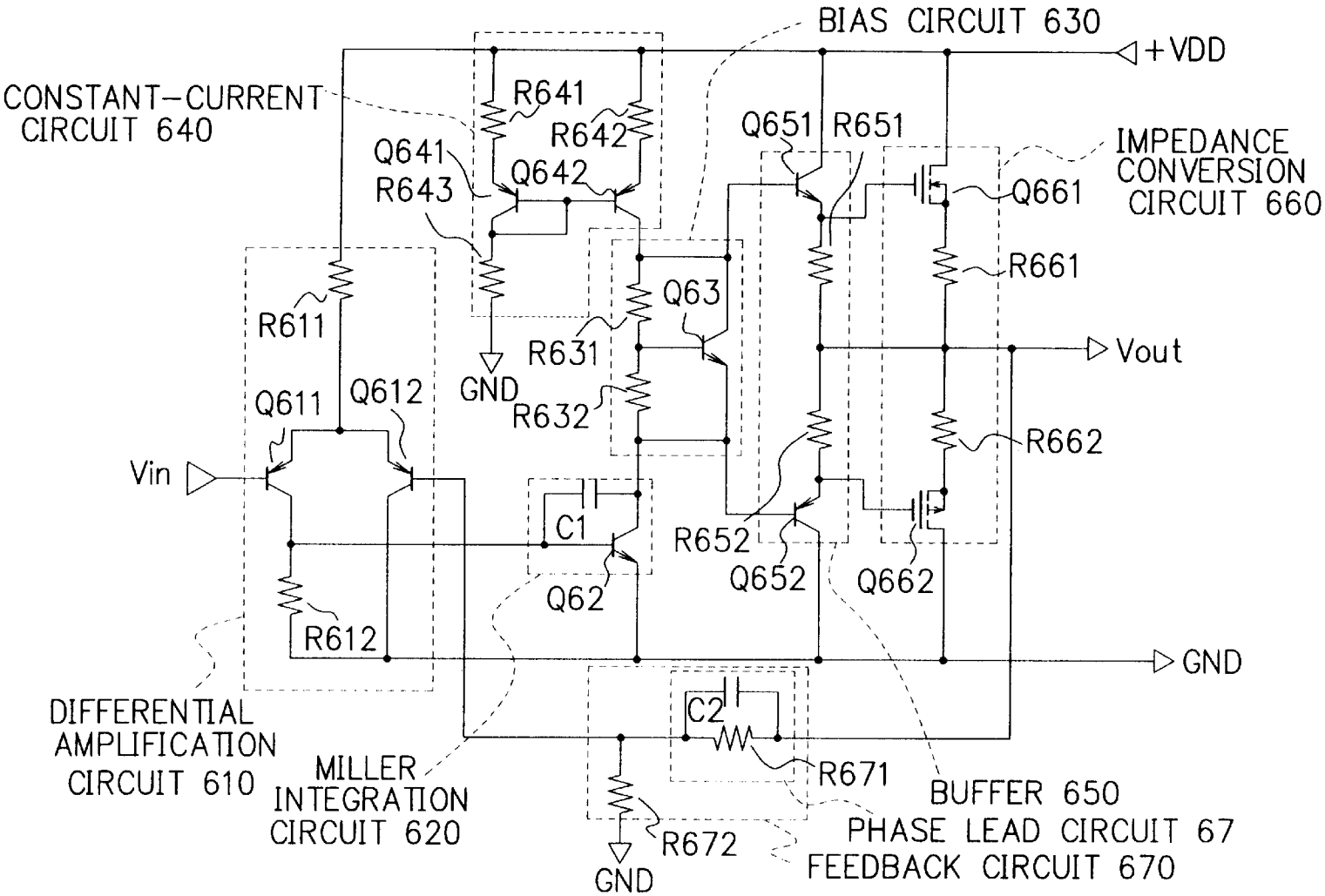
FIG. 8 is a circuit diagram showing an example of the composition of a voltage amplification circuit of the ink jet printing head driving device of FIG. 7.

FIG. 8 is a circuit diagram showing an example of the composition of the voltage amplification circuit 12 (12A, 12B, 12C). The voltage amplification circuit 12 shown in FIG. 8 amplifies the voltage level of the driving signal and thereby drives the multiplexers 21-1~21-*n* with low output impedance. The composition of the voltage amplification circuit 12 of FIG. 8 will be explained in detail later.

The multiplexers 21-1~21-*n* are provided to the ink jet printing head driving device in a one-to-one correspondence with the piezoelectric actuators 23-1~23-*n*. Each multiplexer 21 (21-1~21-*n*) is provided with three transfer gates corresponding to the three driving signals VD1, VD2 and VD3 outputted by the common waveform generation circuit 1.

Each transfer gate of the multiplexer 21 (21-1~21-*n*) is connected to the level conversion circuit 41 as shown in FIG. 7. The level conversion circuit 41 outputs the selection control signals Vc11~Vc32 to each transfer gate. In the example of FIG. 7, selection control signals Vc11 and Vc12 are supplied to the first transfer gate corresponding to the first driving signal VD1, selection control signals Vc21 and Vc22 are supplied to the second transfer gate corresponding to the second driving signal VD2, and selection control signals Vc31 and Vc32 are supplied to the third transfer gate corresponding to the third driving signal VD3. Each transfer gate transmits or interrupts the corresponding driving signal (VD1, VD2 or VD3) depending on the selection control signals supplied from the decoder 42 via the level conversion circuit 41.

The driving signal VD1, VD2 or VD3 selected and transmitted by each multiplexer 21 (21-1~21-*n*) is supplied to a corresponding current amplification circuit 22 (22-1~22-*n*). The current level of the selected driving signal is amplified by the current amplification circuit, and the current-amplified selected driving signal is supplied to a corresponding piezoelectric actuator 23 (23-1~23-*n*), thereby a corresponding vibration plate 52 (52-1~52-*n*) is deformed and the ink drop discharge according to the selected driving signal VD1, VD2 or VD3 is conducted through a corresponding nozzle 54 (54-1~54-*n*).

The composition of the multiplexer (21-1~21-*n*) and the current amplification circuit (22-1~22-*n*) will be described in detail later referring to FIG. 9.

<<Data Transmission Circuit 32 and Data Reception Circuit 43>>

The data transmission circuit 32, which is composed of a latch (parallel) and a shift register, converts parallel data supplied from the image memory 31 into serial data which includes a data signal, a clock signal and a latch signal and sends the serial data to the data reception circuit 43. The data reception circuit 43, which is composed of a latch (serial) and a shift register, converts the serial data supplied from the data transmission circuit 32 into the original parallel data and supplies the parallel data to the decoder 42.

The above parallel-to-serial conversion and the serial-to-parallel conversion by the data transmission circuit 32 and the data reception circuit 43 are executed for the following reasons: The ink jet printing head is usually designed to shift in the horizontal scanning direction after finishing the printing of dots (64 dots, for example) of a column in the vertical scanning direction. Therefore, it is preferable that image data (parallel data) for the above one-column printing in the vertical scanning direction should be read out from the image memory 31 at a time. For implementing such image data readout from the image memory 31, the parallel-to-serial conversion and the serial-to-parallel conversion are executed by the data transmission circuit 32 and the data reception circuit 43. By employing such image data readout on each one-column printing in the vertical scanning direction, the number of wires between the image memory 31 and the data transmission circuit 32 can be set small and thereby circuit scale of the ink jet printing head driving device can be made small.

<<Decoder 42>>

The decoder 42 generates the selection control signals Vc11, Vc12, Vc21, Vc22, Vc31 and Vc32 (for the selection of driving signals to be transmitted by the multiplexers 21-1~21-*n*) based on dot information included in the parallel data supplied from the data reception circuit 43, as mentioned above.

The image data stored in the image memory 31 includes the aforementioned dot information indicating a halftone to be printed on a dot. In this embodiment, 4-step halftone printing is executed for each dot of a color, therefore, 2-bit dot information "00", "01", "10" and "11" are used, for example.

The decoder 42 which received the image data including the dot information generates the selection control signals Vc11, Vc12, Vc21, Vc22, Vc31 and Vc32 for each multiplexer (21-1~21-*n*) corresponding to each dot based on the dot information, and thereby controls the transmission/interruption of the transfer gates of the multiplexers 21-1~21-*n*.

<<Level Conversion Circuit 41>>

The voltage level of the selection control signal (Vc11~Vc32) generated by the decoder 42 is at most 5V by which the transfer gates of the multiplexer 21 can not be turned ON, therefore, the level conversion circuit 41 is provided between the decoder 42 and the multiplexers 21-1~21-*n* in order to amplify the voltage level of the selection control signals Vc11~Vc32 to be supplied to the multiplexers 21-1~21-*n*.

Incidentally, the flow of the image data from the image memory 31 to the multiplexers 21-1~21-*n* via the level conversion circuit 41 etc. will be explained in detail later (in an explanation of the operation of the ink jet printing head driving device of the first embodiment) referring to FIGS. 10 and 11.

<<Voltage Amplification Circuit 12>>

Referring again to FIG. 8 showing an example of the composition of the voltage amplification circuit 12 (12A, 12B, 12C) of the common waveform generation circuit 1, the voltage amplification circuit 12 is mainly composed of a differential amplification circuit 610, a Miller integration circuit 620, a bias circuit 630, a constant-current circuit 640, a buffer 650, an impedance conversion circuit 660 and a feedback circuit 670.

The differential amplification circuit 610 includes two PNP transistors Q611 and Q612 having equivalent characteristics. Voltage difference between the collectors of the two PNP transistors Q611 and Q612 is used as output voltage of the differential amplification circuit 610. To the base of the PNP transistor Q611, the driving signal generated by the waveform generation circuit 11 is applied as an input voltage Vin. To the base of the PNP transistor Q612, a feedback voltage from the feedback circuit 670 receiving the output voltage Vout of the voltage amplification circuit 12 is supplied. By such composition of the differential amplification circuit 610, voltage difference between the driving signal (input voltage Vin) and the feedback voltage is amplified, and the amplified voltage difference is outputted from the collectors of the PNP transistors Q611 and Q612.

The resistor R611 which is connected to the emitters of the two PNP transistors Q611 and Q612 is used for determining and setting currents which pass the collectors of the PNP transistors Q611 and Q612. The resistor R612 which is connected to the collector of the PNP transistor Q611 is used for determining the voltage amplification factor of the differential amplification circuit 610, as will be explained below.

The voltage difference between the collectors of the PNP transistors Q611 and Q612 of the differential amplification circuit 610 is applied to the base and emitter of an NPN transistor Q62 of the Miller integration circuit 620 as a forward bias voltage.

The Miller integration circuit 620, having the NPN transistor Q62 whose emitter is grounded, is generally called a "grounded-emitter circuit". The load resistance on the Miller integration circuit 620 is composed of a parallel connection of a resistance which is equivalent to the current mirror constant-current circuit 640 (hereafter referred to as an "equivalent resistance of the constant-current circuit 640") and the input impedance of the emitter follower buffer 650. However, the equivalent resistance of the constant-current circuit 640 is on the order of MΩ, whereas the input impedance of the buffer 650 is on the order of 10 kΩ. Therefore, the load resistance on the Miller integration circuit 620 is substantially determined by the input impedance of the buffer 650.

The capacitor C1 of the Miller integration circuit 620 determines and sets the total bandwidth of the voltage amplification circuit 12. Therefore, even if an oscillation beyond the bandwidth determined by the capacitor C1 occurred due to the series connection of the input impedance of the piezoelectric actuators 23-1~**23-*n* (load on the voltage amplification circuit 12) and the inductance of wires connecting the voltage amplification circuit 12 and the piezoelectric actuators 23-1~23-*n*, ill effects of the oscillation on the piezoelectric actuators 23-1~23-*n*** are avoided.

The constant-current circuit 640, which has the current mirror structure as mentioned above, includes two PNP transistors Q641 and Q642 (having equivalent characteristics) whose bases are connected together, and three resistors R641, R642 and R643 for determining current passing through the collector of the NPN transistor Q62 of the Miller integration circuit 620. The constant-current circuit 640 operates as load impedance on the NPN transistor Q62 which amplifies the voltage difference outputted by the differential amplification circuit 610. The constant-current circuit 640 has a very high load impedance due to its current mirror structure, therefore, the constant-current circuit 640 contributes to the high open-loop gain of the voltage amplification circuit 12.

The buffer 650 is an emitter follower buffer as mentioned before, in which a resistor R651 is connected to the emitter of an NPN transistor Q651 and a resistor R652 is connected to the emitter of a PNP transistor Q652. In the buffer 650, two grounded-collector circuits are combined together so that the emitters of the NPN transistor Q651 and the PNP transistor Q652 will face each other via the resistors R651 and R652 in push-pull structure, therefore, the buffer 650 has a function for increasing input impedance and decreasing output impedance (impedance conversion function). Therefore, the buffer 650 prevents the decrease of open-loop gain of the voltage amplification circuit 12 at high frequencies.

The decrease of the open-loop gain of the voltage amplification circuit 12 is caused as follows: The impedance conversion circuit 660 which is provided after the buffer 650 is designed to have source follower structure so that its input impedance will be high. MOSFETs Q661 and Q662 of the impedance conversion circuit 660 are used in source follower structure, and thus there is a capacitance (approximately 1000 pF) between the gate and source of each MOSFET, thereby the input impedance decreases as the frequency of the driving signal supplied thereto increases. If such a capacitive load (impedance conversion circuit 660) is connected in series with the load impedance (constant-current circuit 640) having the current mirror structure, the capacitance of the impedance conversion circuit 660 acts in parallel with the load impedance of the constant-current circuit 640, thereby the open-loop gain of the voltage amplification circuit 12 is decreased as the frequency of the input driving signal becomes higher.

In order to prevent the decrease of the open-loop gain of the voltage amplification circuit 12 for high frequency signals, the buffer 650 having the emitter follower structure is placed between the current mirror constant-current circuit 640 and the source follower impedance conversion circuit 660. By such composition of the voltage amplification circuit 12, the aforementioned parallel connection of the capacitance of the impedance conversion circuit 660 and the load impedance of the constant-current circuit 640 is avoided and thereby the decrease of the open-loop gain is prevented.

The bias circuit 630, which is composed of an NPN transistor Q63 and resistors R631 and R632, provides a voltage difference between the gates of the MOSFETs Q661 and Q662 of the impedance conversion circuit 660 which is placed after the buffer 650, thereby prevents distortion of waveforms which are outputted from the sources of the N-MOSFET Q661 and the P-MOSFET Q662 of the impedance conversion circuit 660.

The impedance conversion circuit 660 is a single-ended push-pull (SEPP) impedance conversion circuit, including the N-MOSFET Q661, a resistor R661 connected to the drain of the N-MOSFET Q661, the Airs, P-MOSFET Q662, and a resistor R662 connected to the source of the P-MOSFET Q662. The impedance conversion circuit 660 is provided to the voltage amplification circuit 12 in order to drive the piezoelectric actuators 23-1~**23-*n* through the multiplexers 21-1~21-*n*** with low output impedance.

The piezoelectric actuators 23-1~**23-*n* (loads on the voltage amplification circuit 12) are capacitive loads, therefore, the impedance of the piezoelectric actuators 23-1~23-*n* decreases as the frequency of the driving signal gets higher. Therefore, in order to apply necessary voltage to such low-impedance piezoelectric actuators 23-1~23-*n*, the output impedance of the voltage amplification circuit 12 for applying the voltage has to be set lower than the input impedance of the piezoelectric actuators 23-1~23-*n*. The impedance conversion circuit 660 lowers the output impedance of the voltage amplification circuit 12 and thereby enables the application of necessary voltage to the piezoelectric actuators 23-1~23-*n***.

The reduction of the output impedance of the voltage amplification circuit 12 is also conducted by the feedback circuit 670 which returns part of the output of the voltage amplification circuit 12 to the differential amplification circuit 610 as a feedback voltage. The feedback circuit 670 shown in FIG. 8 is composed of a phase lead circuit 67 (composed of a parallel connection of a resistor R671 and a capacitor C2) and a resistor R672 which is connected to the output side of the phase lead circuit 67 to be grounded. The phase lead circuit 67 advances the phase of the output voltage Vout of the voltage amplification circuit 12 for a certain time constant and supplies the phase-advanced voltage to the base of the PNP transistor Q612 of the differential amplification circuit 610.

The piezoelectric actuators **23-1~23-*n* (loads on the voltage amplification circuit 12) are capacitive loads as mentioned before, therefore, the phase of the driving signal is delayed as the frequency of the driving signal gets higher. Further, such a high frequency signal is easily affected by the resistance and inductance of wiring between the voltage amplification circuit 12 and the multiplexers 21-1~21-*n*. In the voltage amplification circuit 12 including the feedback circuit 670, there is a possibility of signal oscillation if-the phase delay of the driving signal gets close to 180°. Therefore, the phase lead circuit 67 using the time constant is provided to the feedback circuit 670** so as to make phase compensation in order to prevent the growth of the phase delay of the driving signal.

The voltage amplification factor Av of the voltage amplification circuit 12 shown in FIG. 8 is expressed as follows:

$$Av = 1 + \frac{R_{671}}{R_{672}} \tag{1}$$

A detailed explanation of the operation of the voltage amplification circuit 12 will be given later (in the explanation of the operation of the ink jet printing head driving device of the first embodiment).

<<Multiplexer 21 and Current Amplification Circuit 22>>

Figure 9:
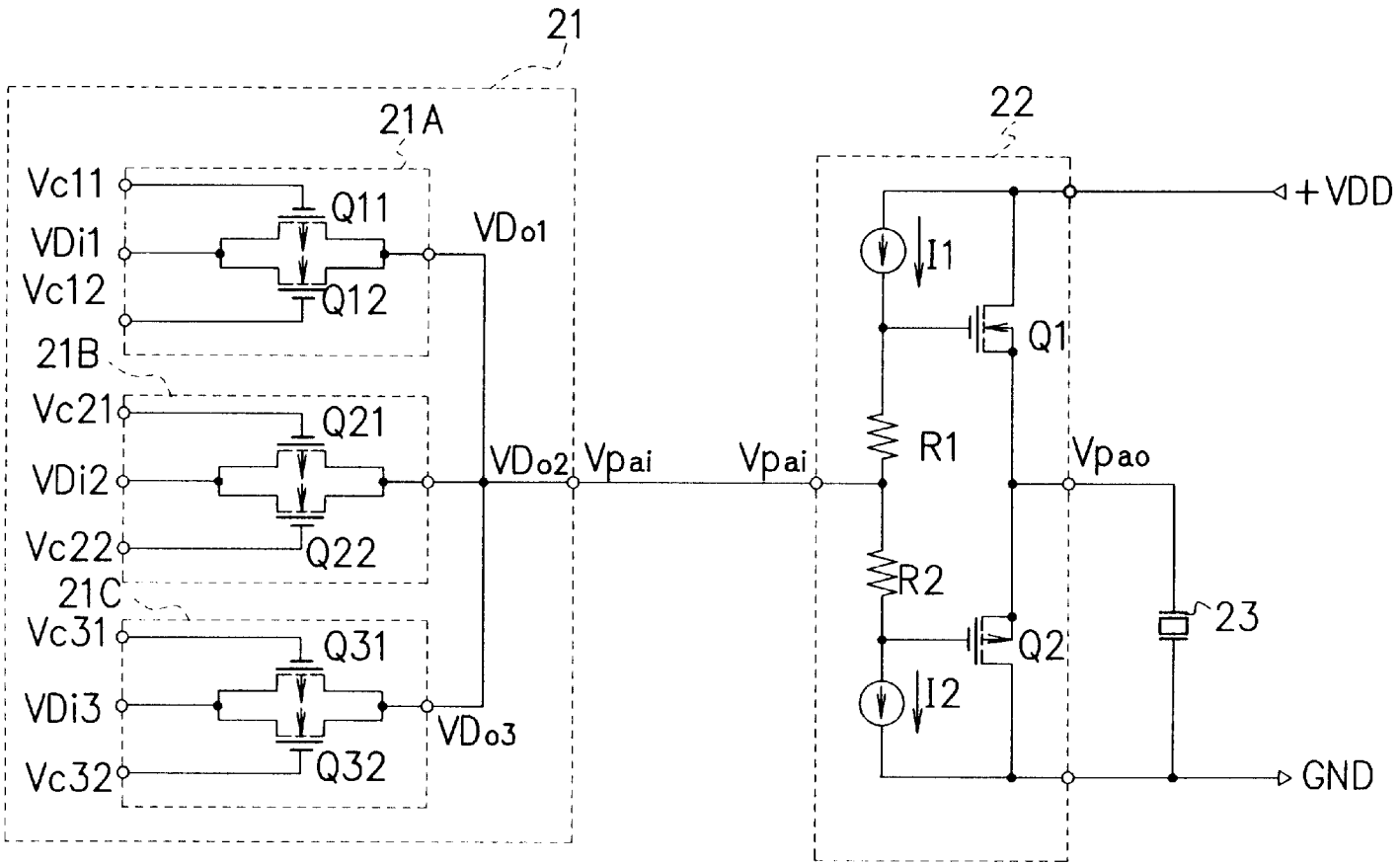
FIG. 9 is a circuit diagram showing an example of the composition of a multiplexer and a current amplification circuit of the ink jet printing head driving device of FIG. 7.

FIG. 9 is a circuit diagram showing an example of the composition of the multiplexer 21 (**21-1~21-*n*) and the current amplification circuit 22 (22-1~22-*n***).

The multiplexer 21 shown in FIG. 9 is composed of three transfer gates 21A, 21B and 21C. The transfer gate 21A is composed of a P-MOSFET Q11 and an N-MOSFET Q12 whose sources and drains are connected together respectively. In the same way, the transfer gate 21B is composed of a P-MOSFET Q21 and an N-MOSFET Q22 whose sources and drains are connected together respectively, and the transfer gate 21C is composed of a P-MOSFET Q31 and an N-MOSFET Q32 whose sources and drains are connected together respectively.

In each transfer gate (21A, 21B, 21C), the driving signal outputted by the common waveform generation circuit 1 is inputted to the sources of the P-MOSFET (Q11, Q21, Q31) and the N-MOSFET (Q12, Q22, Q32). To the gates of the MOSFETs Q11~Q32, the selection control signals Vc11~Vc32 from the level conversion circuit 41 are supplied respectively, thereby the selective transmission of the driving signals supplied from the common waveform generation circuit 1 is executed by the multiplexer 21.

The current amplification circuit 22 shown in FIG. 9 is basically composed of a combination of an N-MOSFET Q1 and a P-MOSFET Q2 in the single-ended push-pull (SEPP) structure. Current for charging the piezoelectric actuator 23 passes through the N-MOSFET Q1, and current discharged from the piezoelectric actuator 23 passes through the P-MOSFET Q2.

Between the drain and gate of each MOSFET (Q1, Q2), a constant current circuit (I1, I2) is provided, and the branch point of a line from the multiplexer 21 is connected to the bases of the N-MOSFET Q1 and the P-MOSFET Q2 through resistors R1 and R2 respectively, thereby a bias voltage (I1×R1+I2×R2) is applied between the gates of the MOSFETs Q1 and Q2.

By setting the bias voltage (I1×R1+I2×R2) higher than the pinch-off voltage of the MOSFETs Q1 and Q2, simultaneous OFF (breaking) of the N-MOSFET Q1 and the P-MOSFET Q2 on the switching of the piezoelectric actuators **23-1~23-*n*** between the charging state and the discharging state can be avoided, thereby distortion of the driving signal can be prevented.

[Operation of the First Embodiment]

In the following, the operation of the ink jet printing head driving device in accordance with the first embodiment of the present invention will be described in detail referring to figures.

Referring again to FIG. 7, the waveform generation circuit 11 of the common waveform generation circuit 1 refers to the waveform information (tables of FIGS. 6A~6C) which has been stored in a record medium such as ROM (unshown) and thereby generates and outputs waveforms corresponding to the driving signals VD1, VD2 and VD3 to the voltage amplification circuits 12A, 12B and 12C respectively.

The voltage levels of the waveforms generated by the waveform generation circuit 11 are within 2V, therefore, the voltage levels have to be amplified to those of the driving signals VD1, VD2 and VD3 (see FIGS. 6A~6C) by the voltage amplification circuits 12A, 12B and 12C. The operation of the voltage amplification circuits 12A, 12B and 12C will be explained in detail later referring to FIG. 8.

The driving signals VD1, VD2 and VD3 outputted by the voltage amplification circuits 12A, 12B and 12C are supplied to each multiplexer 21 (**21-1~21-*n***) through individual lines.

In sync with the supply of the driving signals VD1, VD2 and VD3 to the multiplexers **21-1~21-*n*, the selection control signals Vc11~Vc32 (for the selection of the driving signals transmitted by the multiplexers 21-1~21-*n*) are also supplied to the multiplexers 21-1~21-*n* from the decoder 42 via the level conversion circuit 41**.

As mentioned before, the selection control signals Vc11~Vc32 are signals which are generated by the decoder 42 based on image data which have been stored in the image memory 31. The flow of data from the image memory 31 to the multiplexers **21-1~21-*n* will be explained in detail later referring to FIGS. 10 and 11**.

The current levels of the driving signals VD1, VD2 and VD3 that have been selectively transmitted by the multiplexers **21-1~21-*n* are amplified by the current amplification circuits 22-1~22-*n* so that the piezoelectric actuators 23-1~23-*n* (capacitive loads) can be charged enough, and thereafter the selectively transmitted and current-amplified driving signals VD1, VD2 and VD3 are supplied to the piezoelectric actuators 23-1~23-*n* and thereby the vibration plates 52-1~52-*n* are deformed by the piezoelectric actuators 23-1~23-*n*** for the ink drop discharge.

<<Operation of Voltage Amplification Circuit 12>>

In the following, the operation of the voltage amplification circuit 12 (12A, 12B, 12C) will be explained in detail referring to FIG. 8.

Referring to FIG. 8, the driving signal VD (VD1, VD2, VD3) generated by the waveform generation circuit 11 is supplied to the base of the PNP transistor Q611 of the voltage amplification circuit 12 (12A, 12B, 12C) as the input voltage Vin. To the base of the other PNP transistor Q612 of the voltage amplification circuit 12, the feedback voltage is supplied from the feedback circuit 670 which is receiving the output voltage Vout of the voltage amplification circuit 12, as mentioned before. The differential amplification circuit 610 amplifies the voltage difference between the input voltage Vin (driving signal) and the feedback voltage and supplies the amplified voltage difference to the NPN transistor Q62 of the Miller integration circuit 620.

The amount of current passing to the collector of the PNP transistor Q611 is determined and set by the resistor R611 which is connected to the emitters of the PNP transistors Q611 and Q612. In the same way, the amount of current passing to the collector of the PNP transistor Q612 is also determined and set by the resistor R611.

Thereafter, the driving signal VD applied to the base of the NPN transistor Q62 of the Miller integration circuit 620 is amplified by the Miller integration circuit 620, and the amplified driving signal VD is converted by the bias circuit 630 to a voltage difference (bias voltage) that is larger than the pinch-off voltage of the NPN transistor Q651 and the PNP transistor Q652 of the buffer 650. The driving signal VD which has been converted to the bias voltage is applied to each base of the NPN transistor Q651 and the PNP transistor Q652 of the buffer 650 in order to prevent distortion occurring in waveforms outputted by the N-MOSFET Q661 and the P-MOSFET Q662 of the impedance conversion circuit 660.

At this time, the constant-current circuit 640 is supplying a constant current to the bias circuit 630. If we assume that collector current of the PNP transistor Q642 of the constant-current circuit 640 is $I_{640}$ and collector current of the NPN transistor Q62 of the Miller integration circuit 620 is $I_{620}$, the voltage difference (bias voltage) which is applied between the bases of the NPN transistor Q651 and the PNP transistor Q652 of the buffer 650 is expressed as $(I_{640}\times R_{631}+I_{620}+R_{632})$.

The driving signal VD which has been converted to the bias voltage is applied between the bases of the NPN transistor Q651 and the PNP transistor Q652 of the buffer 650 as above, and the driving signal VD outputted by the buffer 650 is applied to the gates of the N-MOSFET Q661 and the P-MOSFET Q662 of the impedance conversion circuit 660.

As explained before, the buffer 650 is placed between the constant-current circuit 640 and the impedance conversion circuit 660 in order to avoid the parallel connection of the load impedance of the constant-current circuit 640 and the capacitance of the impedance conversion circuit 660.

Through the buffer 650, the bias voltage according to the driving signal VD is applied to the gates of the N-MOSFET Q661 and the P-MOSFET Q662 of the impedance conversion circuit 660, and the driving signal VD obtained from wiring between the resistors R661 and R662 is supplied to the multiplexer 21 as the output of the voltage amplification circuit 12.

Part of the driving signal VD outputted by the impedance conversion circuit 660 (that is, part of the output of the voltage amplification circuit 12) is supplied to the base of the PNP transistor Q612 of the differential amplification circuit 610 via the feedback circuit 670 as a feedback voltage. The voltage amplification circuit 12 maintains its output voltage in equilibrium by use of the feedback voltage as explained below.

The voltage amplification circuit 12 maintains its output voltage in equilibrium so as to satisfy: Vin−βVout=0, where β (<1) is the voltage amplification factor or voltage division coefficient of the feedback circuit 670 which is defined by the following equation (2).

$$\beta = \frac{R_{672}}{R_{671} + R_{672}} \tag{2}$$

In the above equation (2), Vin denotes base voltage of the PNP transistor Q611 of the differential amplification circuit 610 (that is, the input voltage of the voltage amplification circuit 12), and B Vout denotes base voltage of the PNP transistor Q612 of the differential amplification circuit 610 (that is, the feedback voltage supplied from the feedback circuit 670).

Therefore, when the equilibrium Vin=βVout is lost into Vin>βVout, the following processes occur in the voltage amplification circuit 12 so as to maintain the equilibrium. When the equilibrium Vin=βVout is maintained, collector current of the PNP transistor Q611 equals that of the PNP transistor Q612. When Vin exceeded βVout due to the decrease of βVout from the equilibrium Vin=βVout, voltage difference between the emitter and base of the PNP transistor Q611 increases and voltage difference between the base and collector of the PNP transistor Q611 decreases, thereby the collector voltage of the PNP transistor Q611 decreases. Due to the decrease of the collector voltage of the PNP transistor Q611, voltage applied to the base of the NPN transistor Q62 of the Miller integration circuit 620 decreases and thereby collector current of the NPN transistor Q62 decreases.

By the decrease of the collector current of the NPN transistor Q62, voltage drop caused by collector resistance of the NPN transistor Q62 decreases and thereby collector voltage of the NPN transistor Q62 increases. Due to the increase of the collector voltage of the NPN transistor Q62, voltages which are applied to the bases of the NPN transistor Q651 and the PNP transistor Q652 of the buffer 650 also increase. By the increase of the base voltages of the NPN transistor Q651 and the PNP transistor Q652, the outputs of the buffer 650 which are applied to the gates of the N-MOSFET Q661 and the P-MOSFET Q662 of the impedance conversion circuit 660 increase, thereby source voltages of the N-MOSFET Q661 and the P-MOSFET Q662 increase, and thereby the output voltage Vout of the voltage amplification circuit 12 increases. By the increase of the output voltage Vout, the voltage of the base of the PNP transistor Q612 (to which the feedback of the increased output voltage Vout is returned by the feedback circuit 670) also increases.

By the above processes, the base voltages of the PNP transistors Q611 and Q612 of the differential amplification circuit 610 reach the equilibrium Vin=βVout again.

On the other hand, when the equilibrium Vin=βVout is lost into Vin<βVout, the base voltages of the PNP transistors Q611 and Q612 of the differential amplification circuit 610 also return to the equilibrium Vin=βVout according to similar mechanisms.

To sum up, the voltage amplification circuit 12 operates so as to maintain the voltage amplification factor Av which is shown in the following equation (3):

$$Av = \frac{V_{out}}{V_{in}} = \frac{1}{\beta} = 1 + \frac{R_{671}}{R_{672}} \quad (3)$$

<<Voltage Amplification Factor of Voltage Amplification Circuit 12>>

In the following, calculations necessary for deriving the equation (3) (expressing the voltage amplification factor Av of the voltage amplification circuit 12) will be shown.

Main parts of the voltage amplification circuit 12 for conducting voltage amplification are: the differential amplification circuit 610, the Miller integration circuit 620, the buffer 650 and the impedance conversion circuit 660.

The voltage obtained by the voltage amplification by the parts 610, 620, 650 and 660 is amplified (divided) by the feedback circuit 670 (amplification factor is set smaller than 1) and returned to the differential amplification circuit 610 as the feedback voltage. Therefore, the voltage amplification circuit 12 is designed to compare the feedback voltage (indicating the result of the voltage amplification) with the input voltage Vin (supplied from the waveform generation circuit 11) and conduct the voltage amplification based on the comparison. Therefore, the voltage amplification factor Av of the voltage amplification circuit 12 is partly determined by the voltage amplification factor of the feedback circuit 670.

<Voltage Amplification Factor of Differential Amplification Circuit 610>

First, a voltage amplification factor $A_1$ of the differential amplification circuit 610 will be calculated below. If we assume that voltages which are applied to the bases of the PNP transistors Q611 and Q612 of the differential amplification circuit 610 are $V_1$ and $V_2$ and voltage which is applied to the resistor R612 is $V_{01}$, the voltage amplification factor $A_1$ is expressed as the following equation (4) and thus the voltage $V_{01}$ is expressed as the next equation (5).

$$A_1 = \frac{1}{2} R_{612} \frac{hfe_{610}}{hie_{610}} \quad (4)$$

$$V_{01} = -A_1(V_1 - V_2) \quad (5)$$

In the above equation (4), "$R_{612}$" denotes the resistance of the resistor R612, "$hfe_{610}$" denotes the current amplification factor (or grounded-emitter forward direction current amplification factor) of the PNP transistor (Q611, Q612), and "$hie_{610}$" denotes the base input resistance (or grounded-emitter input resistance) of the PNP transistor (Q611, Q612). As seen in the equation (4), the voltage amplification factor $A_1$ of the differential amplification circuit 610 is mainly determined by the resistor R612.

<Voltage Amplification Factor of Miller Integration Circuit 620>

Next, a voltage amplification factor $A_2$ of the Miller integration circuit 620 will be calculated below. As mentioned before, load resistance on the Miller integration circuit 620 is composed of the parallel connection of the current mirror constant-current circuit 640 and the emitter follower buffer 650, and the load resistance on the Miller integration circuit 620 is substantially determined by the input impedance of the buffer 650 since the equivalent resistance of the constant-current circuit 640 is on the order of MΩ and the input impedance of the buffer 650 is on the order of 10 kΩ.

Therefore, when base voltage, collector voltage and collector resistance of the NPN transistor Q62 of the Miller integration circuit 620 are $V_{01}$, $V_{02}$ and Rc, the base voltage $V_{01}$ of the NPN transistor Q62 is expressed as follows:

$$V_{01} = \frac{hfe_{620}}{hie_{620}} R_c \quad (6)$$

where "$hfe_{620}$" denotes the current amplification factor of the NPN transistor Q62, and "$hie_{620}$" denotes the base input resistance of the NPN transistor Q62.

Since the voltage amplification factor of the NPN transistor Q62 is $A_2$, the collector voltage $V_{02}$ of the NPN transistor Q62 is expressed as:

$$V_{02} = -A_2 V_{01} \quad (7)$$

<Voltage Amplification Factor of Buffer 650>

Next, a voltage amplification factor A3 of the buffer 650 will be calculated below. If we assume that the input impedance of a circuit to which signals from the buffer 650 are inputted (that is, the impedance conversion circuit 660) is $R_L$, and the current amplification factor of the NPN/PNP transistor (Q651, Q652) is $hfe_{650}$, and the base input resistance of the NPN/PNP transistor (Q651, Q652) is $hie_{650}$, the voltage amplification factor $A_3$ of the buffer 650 is expressed as follows:

$$A_3 = \frac{1}{1 + \frac{1}{R_L} \frac{hfe_{650}}{hie_{650}}} \quad (8)$$

Incidentally, as mentioned before, the impedance conversion circuit 660 operates as a load circuit on the buffer 650. Input terminals of the impedance conversion circuit 660 are gates of the N-MOSFET Q661 and the P-MOSFET Q662, therefore, almost no current passes through the gates and the input impedance of the impedance conversion circuit 660 becomes substantially infinite. Therefore, the above equation (8) leads to $A_{3\sim1}$. Therefore, the voltage $V_{03}$ outputted by the buffer 650 is approximated as:

$$V_{03} = A_3 V_{02} \approx V_{02} \quad (9)$$

<Voltage Amplification Factor of Impedance Conversion Circuit 660>

Next, a voltage amplification factor $A_4$ of the impedance conversion circuit 660 will be calculated below. The gate of the N-MOSFET Q661 of the impedance conversion circuit 660 is a floating gate and thus passes almost no current. Therefore, the input impedance of the impedance conversion circuit 660 is substantially infinite.

Therefore, when input voltage to the gate of the N-MOSFET Q661 is $V_{03}$ and output voltage from the source of the N-MOSFET Q661 is $V_{04}$, the source output voltage $V_{04}$ and the voltage amplification factor $A_4$ of the impedance conversion circuit 660 (when impedance $Z_L$ of the load (piezoelectric actuators 23-1~**23-*n*) is connected to the impedance conversion circuit 660**) are expressed by the following equations (10) and (11).

$$V_{04} = A_4 V_{03} \quad (10)$$

$$A_4 = \frac{V_{04}}{V_{03}} = \frac{g_m Z_L}{1 + g_m Z_L} = \frac{Z_L}{\frac{1}{g_m} + Z_L} \quad (11)$$

where "$g_m$" is the mutual conductance (or "forward direction transmission admittance" in Y-parameter representation) of the impedance conversion circuit 660, which can be expressed as follows:

$$g_m = \frac{dI_D}{dV_{GS}} \tag{12}$$

where "$dI_D$" denotes variation of drain current of the N-MOSFET Q661 of the impedance conversion circuit 660, and "$dV_{GS}$" denotes variation of voltage between the gate and source of the N-MOSFET Q661.

The "$Z_L$" in the equation (11) denotes load impedance on the voltage amplification circuit 12. In the first embodiment, the load impedance is the impedance of the piezoelectric actuators 23-1~23-*n*as mentioned before. The piezoelectric actuators 23-1~23-*n* are capacitive loads, therefore, when the frequency of an input signal is low or when the total capacitance of the piezoelectric actuators 23-1~23-*n*is small, $|g_m \times Z_L| >> 1$ holds, thereby the voltage amplification factor A4 of the impedance conversion circuit 660 in the equations (10) and (11) becomes approximately 1 ($A_4 \approx 1$).

Therefore, voltage outputted by the impedance conversion circuit 660 can be expressed as follows:

$$V_{04} = A_4\ V_{03} \approx V_{03} \tag{1}$$

<Voltage Amplification Factor of Feedback Circuit 670>

When the voltage amplification factor of the feedback circuit 670 is $\beta(\beta<1)$, the relationship between the input voltage $V_{04}$ and output voltage $V_2$ of the feedback circuit 670 is expressed as:

$$V_2 = \beta V_{04} \tag{14}$$

<Total Voltage Amplification Factor of Voltage Amplification Circuit 12>

To sum up the above voltage amplification factors of the components of the voltage amplification circuit 12 by use of the equations (5), (7), (9), (13) and (14), the output voltage Vout of the voltage amplification circuit 12 is obtained as follows:

$$\begin{aligned} V_{O4} &= A_4 V_{O3} \\ &= A_2 A_3 V_{O2} \\ &= -A_2 A_3 A_4 V_{O1} \\ &= A_1 A_2 A_3 A_4 (V_1 - \beta V_{O4}) \end{aligned} \tag{15}$$

By expressing $A_1\ A_2\ A_3\ A_4$ as $A_0$, the total voltage amplification factor Av of the voltage amplification circuit 12 is expressed as the following equation (16).

$$\begin{aligned} A_V &= \frac{V_{out}}{V_{in}} = \frac{V_{04}}{V_1} = \frac{A_0}{1 + A_0\beta} \\ &= \frac{1}{\frac{1}{A_0} + \beta} \end{aligned} \tag{16}$$

The coefficient $A_0$ is far larger than $\beta$, therefore, the "$1/A_0$" in the equation (16) can be neglected ($1/A_0 \approx 0$). Therefore, the equation (16) leads to:

$$A_V = \frac{V_{out}}{V_{in}} = \frac{1}{\beta} \tag{17}$$

The equation (17) indicates that the total voltage amplification factor Av of the voltage amplification circuit 12 is $1/\beta$ and is only dependent on the voltage amplification factor of the feedback circuit 670, as has been shown in the equation (3).

<<Output Impedance of Voltage Amplification Circuit 12>>

As mentioned before, the piezoelectric actuators 23-1~23-*n*(loads on the voltage amplification circuit 12) are capacitive loads and thus the input impedance of the piezoelectric actuators 23-1~23-*n*decreases as the frequency of the input signal increases. Therefore, the output impedance of the voltage amplification circuit 12 has to be set lower than the total input impedance of the piezoelectric actuators 23-1~23-*n*. If the output impedance of the voltage amplification circuit 12 is higher than the total input impedance of the piezoelectric actuators 23-1~23-*n*, oscillation occurs in transferred signals due to the relationship between the inductance of the wires (between the voltage amplification circuit 12 and the piezoelectric actuators 23-1~23-*n*) and the capacitive load by the piezoelectric actuators 23-1~23-*n*, and thereby precise signal transfer becomes impossible. For the above reasons, the voltage amplification circuit 12 is designed to have low output impedance.

Referring to FIG. 8, the impedance conversion circuit 660 as the output stage is provided to the voltage amplification circuit 12 in order to drive a circuit between the voltage amplification circuit 12 and the piezoelectric actuators 23-1~23-*n* with low impedance. Further, the feedback circuit 670 is provided to the voltage amplification circuit 12 in order to drive the circuit with still lower impedance in comparison with cases where only the impedance conversion circuit 660 is employed. In the following, how the output impedance of the voltage amplification circuit 12 is reduced by the impedance conversion circuit 660 and the feedback circuit 670 will be explained.

The "output impedance" means the impedance of a signal source which is seen from a load. If we express voltage which is applied to the load (piezoelectric actuators 23-1~23-*n*) as "$V_L$" ($V_L \equiv V_{04}$), open-circuit voltage (no-load voltage) of the signal source (impedance conversion circuit 660, voltage amplification circuit 12) as "$V_0$", output impedance of the signal source as "$Z_{out}$", and input impedance of the load as "$Z_L$", the following relationship holds between $Z_{out}$, $Z_L$, $V_L$ and $V_0$:

$$\frac{V_L}{V_O} = \frac{V_{O4}}{V_{O3}} = \frac{Z_L}{Z_{out} + Z_L} \tag{18}$$

Therefore, for realizing precise transmission of the output voltage of the voltage amplification circuit 12 (signal source) to the piezoelectric actuators 23-1~23-*n* (load), that is, for satisfying $V_0 = V_L$, $Z_{out} = 0$ or $Z_L = \infty$ is required.

Based on the above background, the mechanisms of the impedance conversion circuit 660 and the feedback circuit 670 for reducing the output impedance of the voltage amplification circuit 12 will be explained below.

<Impedance Reducing Mechanism of Impedance Conversion Circuit 660>

As mentioned before, the voltage amplification factor $A_4$ of the impedance conversion circuit 660 (when the load impedance $Z_L$ is connected to the impedance conversion circuit 660) is expressed by the equation (11). When $Z_L = \infty$, $A_4 \times 1$ (that is, $V_{04} = V_{03}$) holds in the equation (11) and $V_0 = V_L$ holds ($V_L \equiv V_{04}$), and thus $V_0 = V_{03}$ holds when $Z_L = \infty$. Comparing the above equation (18) with the equation (11), the output impedance $Z_{out}$ of the impedance conversion circuit 660 can be expressed as follows:

$$Z_{out} = \frac{1}{g_m} \tag{19}$$

To sum up, the impedance conversion circuit 660 has infinite input impedance and low output impedance ($1/g_m$).

<Impedance of Piezoelectric Actuators **23-1~23-*n***>

On the other hand, the input impedance of the whole of the piezoelectric actuators **23-1~23-*n* (input impedance $Z_L$ of the load) for the driving frequency in this embodiment is estimated at 0.25 Ω by the following equation (20), assuming that the capacitance of each piezoelectric actuator 23** is 3000 pF and the number of driven piezoelectric actuators is 300.

$$|Z_L| = \frac{1}{2\pi f C} - 0.25\ [\Omega] \tag{20}$$

The input impedance obtained above is very low, therefore, the output impedance of the voltage amplification circuit 12 has to be set still lower in consideration of the relationship of the equation (18). In order to meet the requirement, the output impedance of the voltage amplification circuit 12 is reduced further by use of the feedback circuit 670.

<Impedance Reducing Mechanism of Feedback Circuit 670>

Next, the output impedance of the voltage amplification circuit 12 to which the feedback circuit 670 is added will be obtained below.

While the voltage amplification factor $A_4$ of the impedance conversion circuit 660 was approximated at 1 ($A_4 \approx 1$) in the explanation of the voltage amplification factor, the following explanation of this section will be given by use of the original expression of the voltage amplification factor $A_4$ shown in the equation (11). The voltage amplification factors of the differential amplification circuit 610, the Miller integration circuit 620 and the buffer 650 multiplied together will hereafter be expressed as A ($A=A_1\ A_2\ A_3$).

By use of the above expression, the total voltage amplification factor Av of the voltage amplification circuit 12 can be expressed as follows:

$$\begin{aligned} A_V &= \frac{A_1A_2A_3A_4}{(1 + A_1A_2A_3A_4\beta)} = \frac{A\dfrac{g_mZ_L}{1+g_mZ_L}}{1 + A\beta\dfrac{g_mZ_L}{1+g_mZ_L}} \\ &= \frac{A g_m Z_L}{1 + (1 + A\beta) g_m Z_L} \\ &\approx \frac{A g_m Z_L}{1 + A\beta g_m Z_L} = \frac{A}{\dfrac{1}{g_m Z_L} + A\beta} \\ &= \frac{A}{A\beta}\ \frac{1}{\dfrac{1}{A\beta g_m}\dfrac{1}{Z_L}} \\ &= \frac{1}{\beta}\ \frac{1}{1 + \dfrac{1}{A\beta g_m}\dfrac{1}{Z_L}} \end{aligned} \tag{21}$$

Comparing the equation (21) with the equation (18), the output impedance of the voltage amplification circuit 12 is estimated at $1/(A\beta g_m)$, therefore, the output impedance of the voltage amplification circuit 12 having the feedback circuit 670 is reduced by $1/(A\beta)$ in comparison with the voltage amplification circuit 12 using the impedance conversion circuit 660 only. The output impedance of the voltage amplification circuit 12 can be reduced by use of the feedback circuit 670 as above.

<Relationship Between Impedance and Frequency>

Inductance of wiring between the voltage amplification circuit 12 and the piezoelectric actuators **23-1~23-*n* also contributes to the waveform distortion of the driving signal outputted by the voltage amplification circuit 12. The wire inductance acts in series with the output impedance of the voltage amplification circuit 12** and thereby causes the oscillation of the driving signal.

Since the total load by the piezoelectric actuators **23-1~23-*n* is capacitive as mentioned before, the total impedance of the piezoelectric actuators 23-1~23-*n*** can be expressed as follows:

$$Z_L = \frac{1}{j\omega C} \tag{22}$$

where "C" denotes the total capacitance of the piezoelectric actuators **23-1~23-*n***, "f" denotes the frequency of the driving signal, "ω"=2πf, and "j" denotes the imaginary unit which is defined as $j=(\sqrt{-1})$.

Due to the connection of the load impedance ZL to the voltage amplification circuit 12, the output voltage of the voltage amplification circuit 12 drops. Since the output impedance $Z_{out}$ is $1/(A\beta g_m)$ from the equation (21), the voltage drop rate ([output voltage of the voltage amplification circuit 12 when $Z_L$ is not connected]/[output voltage of the voltage amplification circuit 12 when $Z_L$ is connected]) is expressed as follows:

$$\frac{\beta V_L}{V_{in}} = \frac{Z_L}{Z_{out} + Z_L} = \frac{\dfrac{1}{j\omega C}}{\dfrac{1}{A\beta gm} + \dfrac{1}{j\omega C}} \tag{23}$$

In addition to the above load, the inductance L of the wiring between the voltage amplification circuit 12 and the piezoelectric actuators **23-1~23-*n*** acts in series, therefore, actual voltage drop rate is expressed as follows:

$$\frac{\beta V_L}{V_{in}} = \frac{\dfrac{1}{j\omega C}}{\dfrac{1}{A\beta gm} + j\omega C + \dfrac{1}{j\omega C}} \tag{24}$$

Concretely, if we assume A=20000, β×1/16, $g_m$=10 [S], L=0.1 [μH], ω=2π×700 [Krad/sec], and C=0.9 [μF], each impedance factor in the above equation (24) is estimated as: $Z_{out}=1/(\mu g_m)=80$ [μΩ], ω×L=0.44 [Ω], and 1/(ω×C)=0.25 [Ω]. Therefore, the output impedance $Z_{out}=1/(A\beta g_m)$ in the equation (24) can be neglected, whereas the effect of the wire inductance becomes dominant.

A resonance frequency $f_s$ which is determined by the relationship between the inductance and the capacitive load can be expressed as the following equation (25). Using the above values of L and C, signal oscillation occurs at the resonance frequency $f_s$ of 530 kHz.

$$f_S = \frac{1}{2\pi\sqrt{LC}} \tag{25}$$

In short, when a large capacitive load is driven, the effect of the wire inductance becomes dominant and thereby signal oscillation is caused.

In order to eliminate the effect of the oscillation on the voltage amplification circuit 12, the capacitors C1 and C2 are provided to the Miller integration circuit 620 and the feedback circuit 670 respectively as shown in FIG. 8. The capacitors C1 and C2 are named a "Miller capacitor" and a "phase compensation capacitor".

For eliminating the oscillation, two measures can be taken: First, the oscillation nearby the driving frequency can be eliminated by reducing the wire inductance by shortening the wiring between the voltage/current amplification circuit and the piezoelectric actuators 23-1~23-*n*. Second, the oscillation can be avoided by reducing the capacitance of the load by reducing the number of simultaneously driven piezoelectric actuators.

Therefore, in the present invention, the current amplification circuit 22 (22-1~22-*n*) is provided in front of each piezoelectric actuator 23 (23-1~23-*n*) in a one-to-one correspondence, thereby the length of the wiring between the current amplification circuit 22 and the piezoelectric actuator 23 can be made short. Further, one current amplification circuit 22 drives only one piezoelectric actuator 23. By such composition of the ink jet printing head driving device of this embodiment, the oscillation occurring to the driving signal VD is eliminated.

<<Operation of Multiplexer 21 and Current Amplification Circuit 22>>

In the following, the operation of the multiplexer 21 (21-1~21-*n*) and the current amplification circuit 22 (22-1~22-*n*) will be explained in detail referring to FIG. 9.

<Operation of Multiplexer 21>

As shown in FIG. 9, the multiplexer 21 is composed of three transfer gates 21A, 21B and 21C each of which is composed of two N-MOSFETs. The selection control signals Vc11 and Vc12 supplied from the decoder 42 via the level conversion circuit 41 are applied to the gates of the two N-MOSFETs of the transfer gate 21A respectively. The selection control signals Vc21 and Vc22 are applied to the gates of the two N-MOSFETs of the transfer gate 21B respectively. The selection control signals Vc31 and Vc32 are applied to the gates of the two N-MOSFETs of the transfer gate 21C respectively. The details of the selection control signals Vc11~Vc32 will be explained later referring to FIGS. 10 and 11.

The driving signals VD1, VD2 and VD3 supplied from the common waveform generation circuit 1 are inputted to the transfer gates 21A, 21B and 21C respectively. In sync with the supply of the driving signals VD1, VD2 and VD3, the selection control signals Vc11~Vc32 are also supplied to the transfer gates 21A, 21B and 21C respectively, thereby one (or zero) of the driving signals VD1, VD2 and VD3 is selected and transmitted by the multiplexer 21.

<Operation of Current Amplification Circuit 22>

Thereafter, the driving signal (VD1, VD2 or VD3) selected and transmitted by the multiplexer 21 is inputted to the current amplification circuit 22. The current amplification circuit 22 in the first embodiment includes an N-MOSFET Q1 and a P-MOSFET Q2 in the single-ended push-pull (SEPP) structure as mentioned before. For electrically charging the piezoelectric actuator 23 (23-1~23-*n*) corresponding to the current amplification circuit 22 (22-1~22-*n*), the N-MOSFET Q1 is brought into conduction. On the other hand, for the electrical discharge of the piezoelectric actuator 23, the P-MOSFET Q2 is brought into conduction.

The driving signal VD inputted to the current amplification circuit 22 is converted to a bias voltage by the constant current circuits I1 and 12 and the resistors R1 and R2, and the bias voltage is applied to each gate of the N-MOSFET Q1 and the P-MOSFET Q2, therefore, when the voltage level of the inputted driving signal VD is lower than a reference voltage, the N-MOSFET Q1 is set OFF and the P-MOSFET Q2 is set ON, and thereby the piezoelectric actuator 23 is electrically discharged. On the other hand, when the voltage level of the inputted driving signal VD is higher than the reference voltage, the N-MOSFET Q1 is set ON and the P-MOSFET Q2 is set OFF and thereby the piezoelectric actuator 23 is electrically charged.

As mentioned before, in the current amplification circuit 22, the voltage difference between the voltage applied to the gate of the N-MOSFET Q1 and the voltage applied to the gate of the P-MOSFET Q2 is set higher than the pinch-off voltage of the N-MOSFET Q1 and the P-MOSFET Q2, thereby the distortion of the driving signal VD on the switching of the N-MOSFET Q1 and the P-MOSFET Q2 between the charging state and the discharging state can be prevented.

By the electrical charging/discharging operation of the current amplification circuit 22 according to the inputted driving signal VD, the piezoelectric actuator 23 deforms a corresponding vibration plate 52, thereby the volume of a corresponding pressure generation chamber 53 is changed and thereby the ink drop discharge from a corresponding nozzle 54 is conducted.

The driving signal VD (input voltage Vpzi) inputted to the current amplification circuit 22 is applied to the gates of the N-MOSFET Q1 and the P-MOSFET Q2 via the resistors R1 and R2, respectively. The voltage applied to the gate of the N-MOSFET Q1 is (Vpzi+I1×R1) V, which is higher than the input voltage Vpzi by a voltage drop due to the resistor R1. The voltage applied to the gate of the P-MOSFET Q2 is (Vpzi−I2×R2) V, which is lower than the input voltage Vpzi by a voltage drop due to the resistor R2.

By setting the voltage drops (I1×R1) and (I2×R2) equal to the voltage difference $V_{GS}$ between the gate and source of each MOSFET, the N-MOSFET Q1 and the P-MOSFET Q2 are set ON and OFF respectively when the input voltage Vpzi is higher than the voltage Vpzo of the piezoelectric actuator 23, and the N-MOSFET Q1 and the P-MOSFET Q2 are set OFF and ON respectively when the input voltage Vpzi is lower than the voltage Vpzo of the piezoelectric actuator 23. By the ON-OFF action of the N-MOSFET Q1 and the P-MOSFET Q2, the piezoelectric actuator 23 is electrically charged when the input voltage Vpzi is higher than the voltage Vpzo of the piezoelectric actuator 23, and the piezoelectric actuator 23 is electrically discharged when the input voltage Vpzi is lower than the voltage Vpzo of the piezoelectric actuator 23.

By the operation described above, the current amplification circuit 22 shown in FIG. 9 operates so as to make the input voltage Vpzi and the output voltage Vpzo equal, and converges the voltage of (the positive electrode of) the piezoelectric actuator 23 to the output voltage of the common waveform generation circuit 1. Therefore, the voltage amplification factor of the current amplification circuit 22 is 1 and the current amplification circuit 22 conducts current amplification only. When no driving signal is inputted (that is, when the input voltage Vpzi is 0 V), the voltage of the piezoelectric actuator 23 also becomes 0 V.

Almost no power consumption occurs in the MOSFETs Q1 and Q2, therefore, the current amplification circuit 22 shown in FIG. 9 is very suitable for the implementation as an IC.

<<Selection Control Signals Vc11~Vc32>>

In the following, the flow of the selection control signals Vc11~Vc32 (based on the image data stored in the image memory 31) into the multiplexers 21-1~**21-*n* will be explained in detail referring to FIGS. 10 and 11**.

Figure 10:
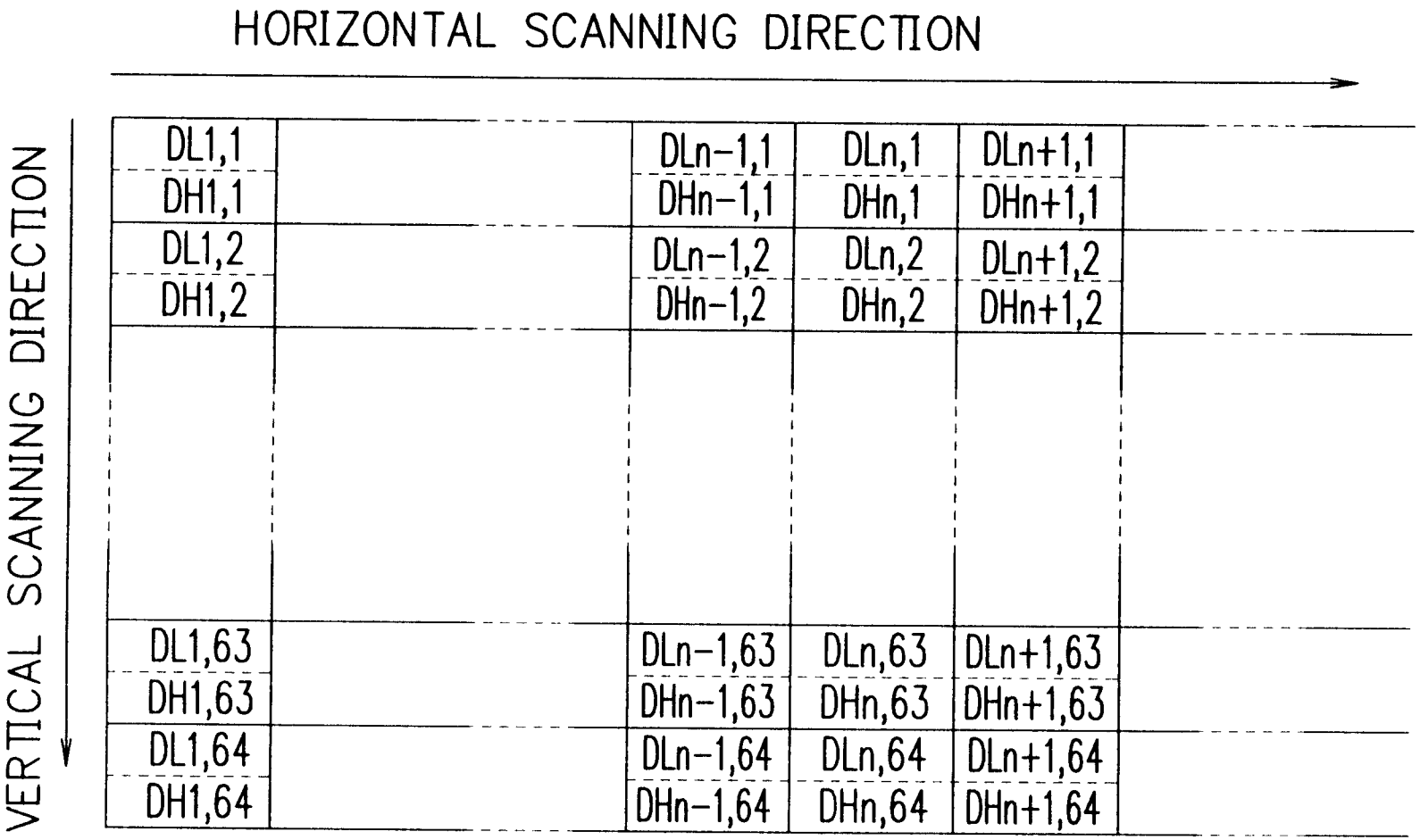
FIG. 10 is a table showing the contents of image data which is stored in image memory of the ink jet printing head driving device of FIG. 7.

FIG. 10 is a table showing the contents of the image data which is stored in the image memory 31. The image data shown in FIG. 10 includes dot information for M×64 dots (M ($1 \leqq n \leqq M$) dots in the horizontal scanning direction×64 dots in the vertical scanning direction). The dot information for each dot is composed of 2 bits so as to be capable of indicating 4 dot values for the 4-step halftone printing. Concretely, dot information for a dot (n, i) ($1 \leqq n \leqq M$, $1 \leqq i \leqq 64$) includes data $DL_{n,i}$ and $DH_{n,i}$. For example, ($DL_{n,i}$, $DH_{n,i}$)=(0, 0), (1, 0), (0, 1) and (1, 1) are used for indicating "no printing", "large ink drop", "middle ink drop" and "small ink drop", respectively. Each column (128 pieces of dot information for 64 dots) in the image data shown in FIG. 10 is handled as the aforementioned parallel data.

Figure 11:
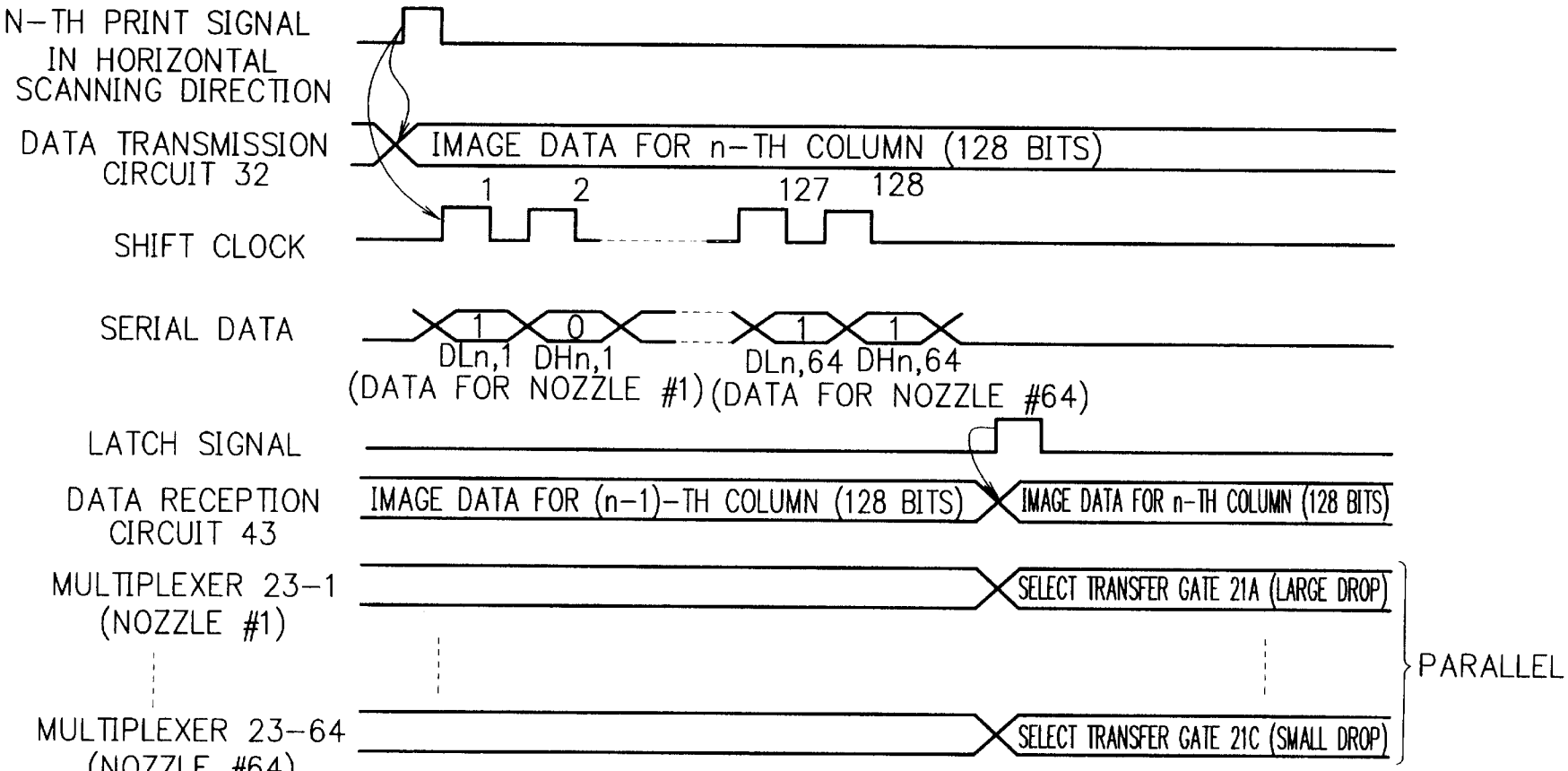
FIG. 11 is a timing chart showing the flow of signals (image data, selection control signals, etc.) from the image memory to the multiplexers of the ink jet printing head driving device of FIG. 7.

FIG. 11 is a timing chart showing the flow of signals (image data, selection control signals, etc.) from the image memory 31 to the multiplexers 21-1~**21-*n***.

Referring to FIG. 11, when an n-th "print signal" in the horizontal scanning direction is supplied, the image memory 31 outputs 128-bit image data ($DL_{n,1}$, $DH_{n,1}$), ($DL_{n,2}$, $DH_{n,2}$), . . . , ($DL_{n,64}$, $DH_{n,64}$) to the data transmission circuit 32 as the aforementioned parallel data.

The data transmission circuit 32 is a 128-bit shift register of parallel input and serial output. On the other hand, the data reception circuit 43 is a 128-bit shift register of serial input and parallel output.

When the data transmission circuit 32 received the 128-bit image data (parallel data) from the image memory 31, the data transmission circuit 32 generates 128 shift clocks successively. In sync with the 128 shift clocks, the 128-bit image data stored in the data transmission circuit 32 is successively outputted to the data reception circuit 43 as serial data. The data reception circuit 43 successively stores the 128-bit image data (serial data) supplied from the data transmission circuit 32 in sync with the 128 shift clocks.

After outputting the 128 shift clocks, the data transmission circuit 32 outputs a latch signal to the data reception circuit 43. The data reception circuit 43 which received the latch signal outputs the stored 128-bit image data to the decoder 42 as parallel data.

The decoder 42 which received the 128-bit image data (parallel data) decodes or interprets the 128-bit image data ($DL_{n,1}$, $DH_{n,1}$), ($DL_{n,2}$, $DH_{n,2}$), . . . , ($DL_{n,64}$, $DH_{n,64}$), and thereby outputs the selection control signals Vc11~Vc32 for each multiplexer 21 (21-1~**21-*n*) so that one (or zero) of the transfer gates of the multiplexer 21 will be ON. Incidentally, the voltage level of the selection control signals Vc11~Vc32 generated by the decoder 42 (~5V) is raised by the level conversion circuit 41 to a level (10~40V) which is suitable for driving the transfer gates of the multiplexers 21-1~21-*n***.

Concretely, if ($DL_{n,1}$, $DH_{n,1}$)=(0, 0), all the transfer gates 21A, 21B and 21C of the multiplexer 21-1 are set OFF so that no ink drop will be discharged from a corresponding nozzle #1. If ($DL_{n,1}$, $DH_{n,1}$)=(1, 0), only the transfer gate 21A is set ON in the multiplexer 21-1 so that a large ink drop will be discharged from the nozzle #1. If ($DL_{n,1}$ $DH_{n,1}$)=(0, 1), only the transfer gate 21B is set ON in the multiplexer 21-1 so that a middle ink drop will be discharged from the nozzle #1. If ($DL_{n,1}$, $DH_{n,1}$)=(1, 1), only the transfer gate 21C is set ON in the multiplexer 21-1 so that a small ink drop will be discharged from the nozzle #1. In the example of FIG. 11, a large ink drop is discharged from the nozzle #1 (($DL_{n,1}$, $DH_{n,1}$)=(1, 0)) and a small ink drop is discharged from the nozzle #64 (($DL_{n,64}$, $DH_{n,64}$)=(1, 1)).

[Embodiment 2]

Figure 12:
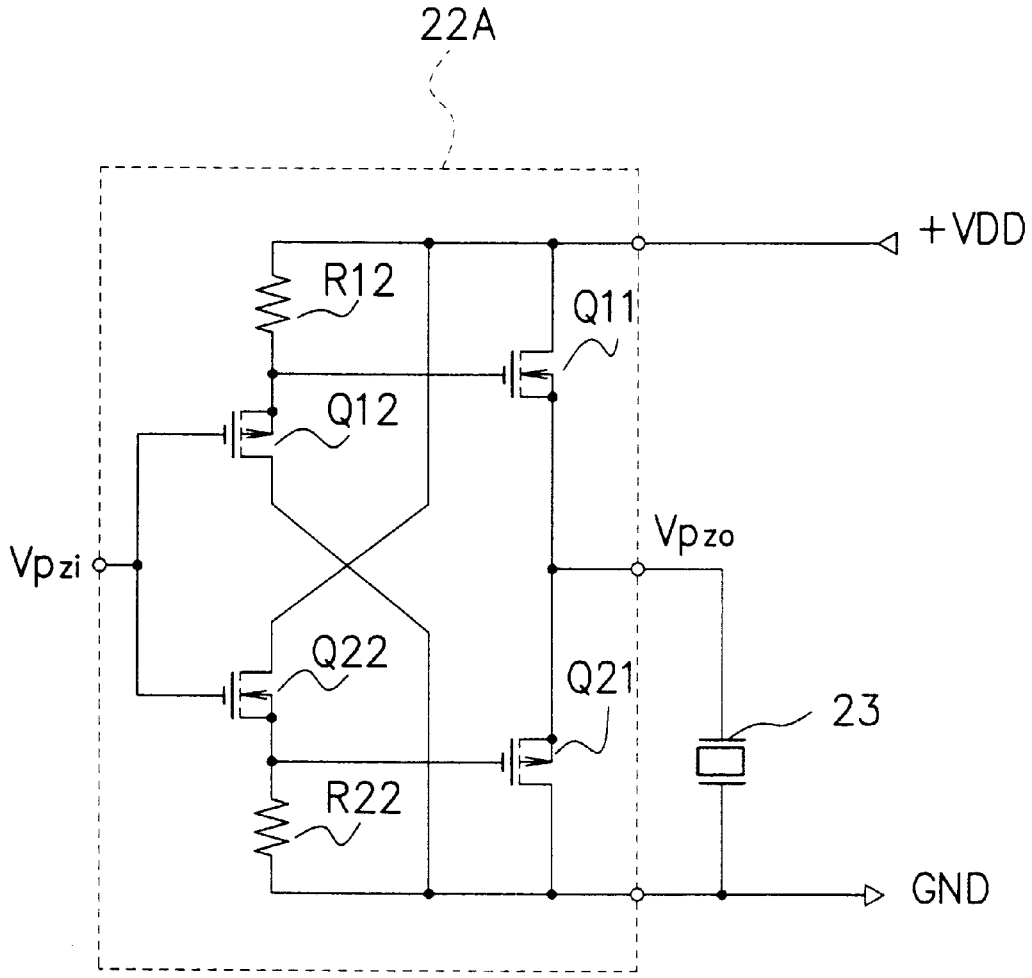
FIG. 12 is a circuit diagram showing the composition of a current amplification circuit which is employed in an ink jet printing head driving device in accordance with a second embodiment of the present invention.

FIG. 12 is a circuit diagram showing the composition of a current amplification circuit 22A (22A-1~22A-*n*) which is employed in an ink jet printing head driving device in accordance with a second embodiment of the present invention. In the second embodiment, the current amplification circuits 22A are used instead of the current amplification circuits 22 of the first embodiment. The other components of the ink jet printing head driving device of the second embodiment are the same as those of the first embodiment.

Referring to FIG. 12, the current amplification circuit 22A of the second embodiment includes a single-ended push-pull source follower which is composed of an N-MOSFET Q11 and a P-MOSFET Q21, and a bias circuit composed of an P-MOSFET Q12, an N-MOSFET Q22 and resistors R12 and R22. The resistor R12 is connected to the source of the P-MOSFET Q12 in order to determine and set the amount of current passing between the source and drain of the P-MOSFET Q12. In the same way, the resistor R22 is connected to the source of the N-MOSFET Q22 in order to determine and set the amount of current passing between the source and drain of the N-MOSFET Q22.

The N-MOSFET Q11 and the P-MOSFET Q21 are connected in the source follower structure, and thus exhibits a current amplification function.

In the bias circuit, the P-MOSFET Q12 and the N-MOSFET Q22 of polarities that are opposite to those of the following N-MOSFET Q11 and P-MOSFET Q21 are used. By such composition, the pinch-off voltage between the gate and source of each of the N-MOSFET Q11 and the P-MOSFET Q21 is canceled out and thereby the distortion of output waveforms is prevented.

The driving signal VD (input voltage Vpzi) supplied to the current amplification circuit 22A is applied to the gates of the P-MOSFET Q12 and the N-MOSFET Q22.

The voltage difference between the gate and source of the P-MOSFET Q12 is set equal to the pinch-off voltage of the N-MOSFET Q11, and the voltage difference between the gate and source of the N-MOSFET Q22 is set equal to the pinch-off voltage of the P-MOSFET Q21. When the input voltage Vpzi is higher than the voltage Vpzo of the piezoelectric actuator 23, the N-MOSFET Q11 and the P-MOSFET Q21 are set ON and OFF respectively and thereby the piezoelectric actuator 23 is electrically charged. When the input voltage Vpzi is lower than the voltage Vpzo of the piezoelectric actuator 23, the N-MOSFET Q11 and the P-MOSFET Q21 are set OFF and ON respectively and thereby the piezoelectric actuator 23 is electrically discharged. The above charging/discharging operation continues until the voltage Vpzo of the piezoelectric actuator 23 gets equal to the input voltage Vpzi.

To sum up, the current amplification circuit 22A shown in FIG. 12 operates so as to make the input voltage Vpzi and the output voltage Vpzo equal and converges the voltage of (the positive electrode of) the piezoelectric actuator 23 to the output voltage of the common waveform generation circuit 1. Therefore, the voltage amplification factor of the current amplification circuit 22A is 1 and the current amplification circuit 22A conducts current amplification only. The voltage of the piezoelectric actuator 23 becomes 0 V when no driving signal is inputted to the current amplification circuit 22A (that is, when the input voltage Vpzi is 0 V).

Almost no power consumption occurs in the MOSFETs Q12 and Q22, therefore, the current amplification circuit 22A shown in FIG. 12 is very suitable for the implementation as an IC.

[Embodiment 3]

Figure 13:
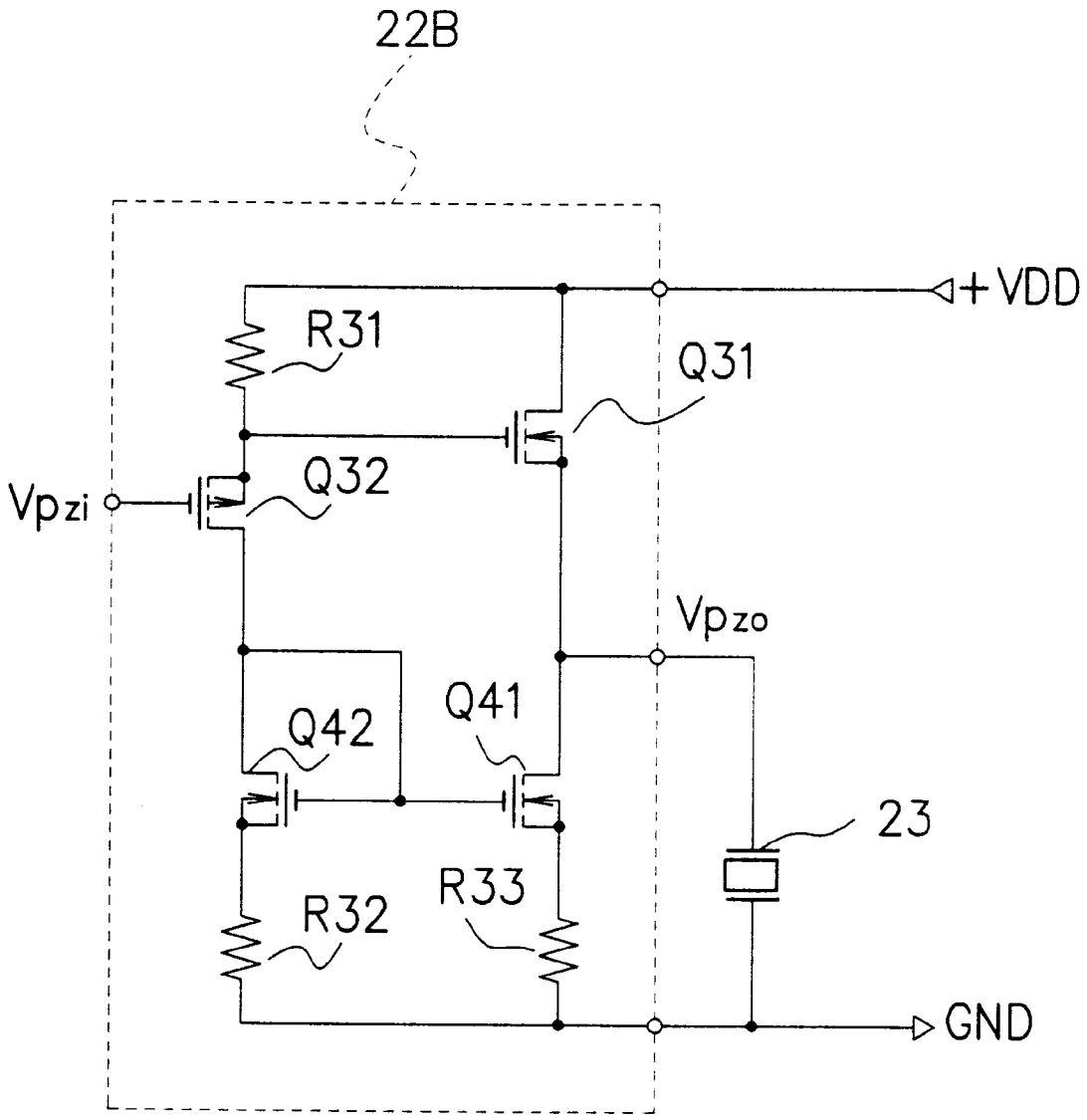
FIG. 13 is a circuit diagram showing the composition of a current amplification circuit which is employed in an ink jet printing head driving device in accordance with a third embodiment of the present invention.

FIG. 13 is a circuit diagram showing the composition of a current amplification circuit 22B (22B-1~22B-*n*) which is employed in an ink jet printing head driving device in accordance with a third embodiment of the present invention. In the third embodiment, the current amplification circuits 22B are used instead of the current amplification circuits 22 and the current amplification circuits 22A of the above embodiments. The other components of the ink jet printing head driving device of the third embodiment are the same as those of the first embodiment.

Referring to FIG. 13, the current amplification circuit 22B of the third embodiment includes a source follower (which is composed of N-MOSFETs Q31 and Q41) and a current mirror constant current circuit (including P-MOSFET Q32 and an N-MOSFET Q42) which is added to the source follower. The resistors R31, R32 and R33 are provided in order to determine and set the amounts of currents passing through the P-MOSFET Q32, the N-MOSFET Q42 and the N-MOSFET Q41, respectively.

The N-MOSFETs Q31 and Q41 are connected in the source follower structure, and thus exhibits a current amplification function.

The current mirror constant current circuit keeps the current passing through the source follower constant, thereby the pinch-off voltage between the gate and source of each of the N-MOSFETs Q31 and Q41 is canceled out and thereby the distortion of output waveforms is prevented.

The driving signal VD (input voltage Vpzi) supplied to the current amplification circuit 22B is applied to the gates of the N-MOSFETs Q31 and Q41 via the P-MOSFET Q32.

When the input voltage Vpzi is higher than the voltage Vpzo of the piezoelectric actuator 23, current passes through the N-MOSFET 31 to the piezoelectric actuator 23 and thereby the piezoelectric actuator 23 is electrically charged until the until the voltage Vpzo of the piezoelectric actuator 23 gets equal to the input voltage Vpzi. When the input voltage Vpzi is lower than the voltage Vpzo of the piezoelectric actuator 23, current passes through the N-MOSFET 41 to the ground and thereby the piezoelectric actuator 23 is electrically discharged until the until the voltage Vpzo of the piezoelectric actuator 23 gets equal to the input voltage Vpzi.

The current amplification circuit 22B shown in FIG. 13 operates so as to make the input voltage Vpzi and the output voltage Vpzo equal and converges the voltage of (the positive electrode of) the piezoelectric actuator 23 to the output voltage of the common waveform generation circuit 1, similarly to the current amplification circuits 22 and 22A of the previous embodiments. Therefore, the voltage amplification factor of the current amplification circuit 22B is L-and the current amplification circuit 22B conducts current amplification only. The voltage of the piezoelectric actuator 23 becomes 0 V when no driving signal is inputted to the current amplification circuit 22B (that is, when the input voltage Vpzi is 0 V).

Similarly to the current amplification circuits 22 and 22A of the previous embodiments, the current amplification circuit 22B shown in FIG. 13 is very suitable for the implementation as an IC since almost no power consumption occurs in the MOSFETs.

Further, the current amplification circuit 22B includes only 1 P-MOSFET (which is generally larger in size than an N-MOSFET), therefore, the degree of integration can be further increased by employing the current amplification circuits 22B of the third embodiment.

As described above, in the driving devices and the driving methods for an ink jet printing head in accordance with the present invention, a current amplification circuit (22, 22A, 22B) for driving a piezoelectric actuator 23 is provided between a multiplexer 21 (for selectively transmitting the driving signals according to image data) and a piezoelectric actuator 23 in a one-to-one correspondence. Therefore, even when a plurality of piezoelectric actuators 23 having large load capacitance are used in the ink jet printing head, stable and distortion-free driving signals VD can be supplied to the piezoelectric actuators 23, thereby the diameter of ink drops discharged from the ink jet printing head can be stabilized and thereby high quality printing can be realized.

The voltage amplification circuits 12 (12A, 12B, 12C) of the common waveform generation circuit 1 do not drive the piezoelectric actuators 23 directly. Therefore, currents passing through the voltage amplification circuit 12 can be set small and thereby heat emission and circuit scale of the voltage amplification circuit 12 can be reduced.

Owing to the low output current levels of the voltage amplification circuits 12 (12A, 12B, 12C), the multiplexers 21-1~21-*n* can be implemented with small circuit scales and thereby the degree of integration of an IC including the multiplexers 21-1~21-*n* can be increased.

Further, by employing the current amplification circuit 22B of the third embodiment, the degree of integration of an IC including the current amplification circuits can be increased further.

In the following, a comparison between the present invention and the prior art of FIG. 1 will be made from the viewpoint of signal distortion, referring to simulation results.

Figure 14:
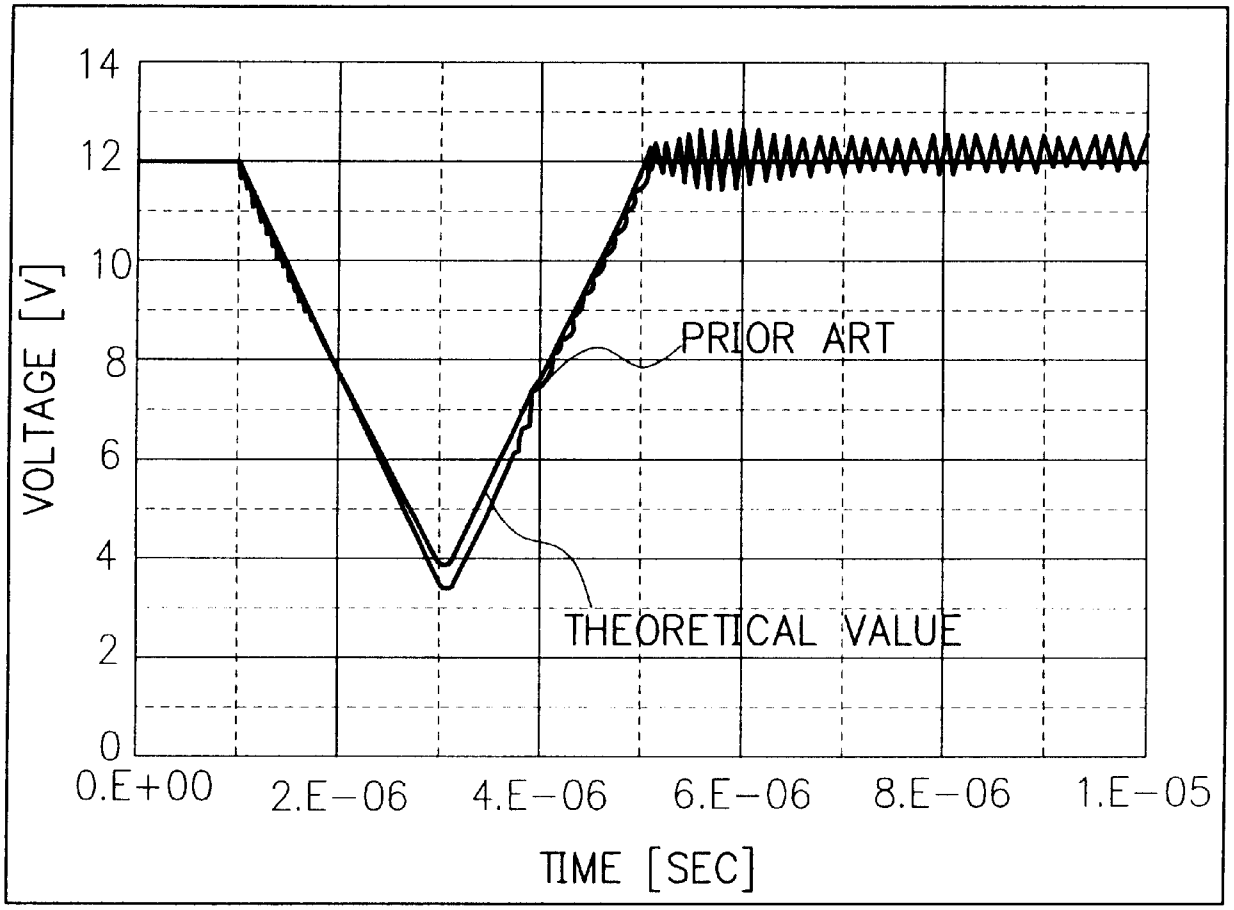
FIG. 14 is a graph showing a simulation result of a driving signal which is supplied to a piezoelectric actuator of an ink jet printing head by use of the conventional ink jet printing head driving device of FIG. 1.

FIG. 14 is a graph showing a simulation result of a driving signal which is supplied to a piezoelectric actuator of an ink jet printing head by use of the conventional ink jet printing head driving device of FIG. 1. In FIG. 14, "THEORETICAL VALUE" indicates an ideal case where the driving signal outputted by the common waveform generation circuit 101 is applied to the piezoelectric actuator with no effect of signal distortion due to the circuit, and "PRIOR ART" indicates the case of the conventional ink jet printing head driving device of FIG. 1. In the case of the prior art, signal oscillation occurs to the driving signal as shown in FIG. 14. The signal oscillation is caused by the capacitance by the piezoelectric actuators 123 and the wire inductance between the common waveform generation circuit 101 and the piezoelectric actuators 123. In order to eliminate the signal distortion due to the capacitance and the wire inductance, the number of piezoelectric actuators 123 that are simultaneously driven by the common waveform generation circuit 101 has to be reduced, or the wiring between the common waveform generation circuit 101 and the piezoelectric actuators 123 has to be shortened.

Figure 15:
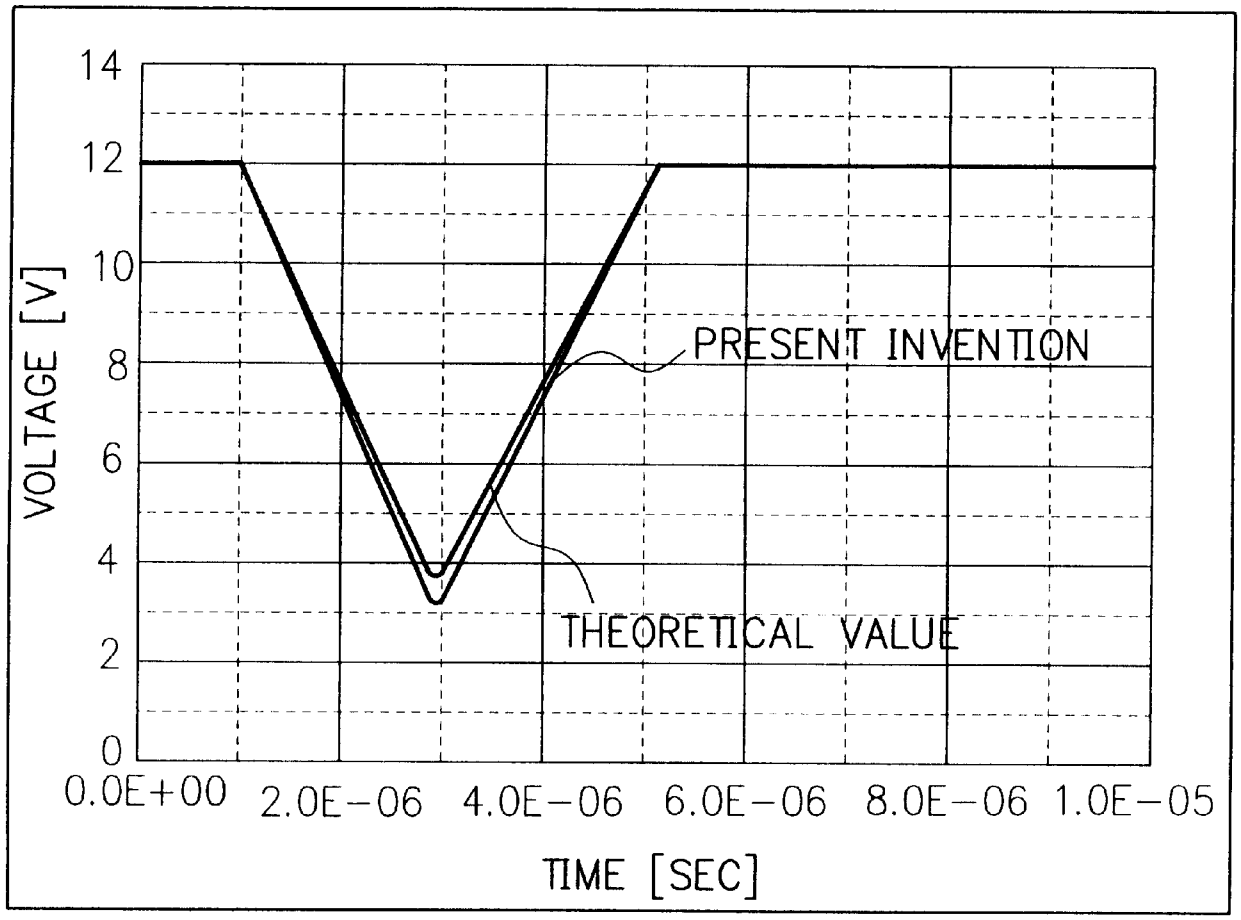
FIG. 15 is a graph showing a simulation result of a driving signal which is supplied to a piezoelectric actuator of an ink jet printing head by use of the ink jet printing head driving device in accordance with the present invention.

FIG. 15 is a graph showing a simulation result of a driving signal which is supplied to a piezoelectric actuator of an ink jet printing head by use of the ink jet printing head driving device in accordance with the present invention. As shown in FIG. 15, by use of the driving device of the present invention, a driving signal having almost the same waveform as the distortion-free theoretical waveform (THEORETICAL VALUE) can be applied to the piezoelectric actuator 23, since a current amplification circuit (22, 22A, 22B) drives only one piezoelectric actuator 23 and the length of the direct wiring between the current amplification circuit 22 and the piezoelectric actuator 23 can be set very short.

As set forth hereinabove, in the driving devices and the driving methods for an ink jet printing head in accordance with the present invention, a current amplification circuit (22, 22A, 22B) (hereafter, simply referred to as "current amplification circuit 22") for driving a piezoelectric actuator 23 is provided between a multiplexer 21 (for selectively transmitting the driving signals according to the selection control signals Vc11~Vc32 based on image data) and a piezoelectric actuator 23 in a one-to-one correspondence. The current amplification circuit 22 is designed to have high input impedance, therefore, load impedance seen from the voltage amplification circuit 12 of the common waveform generation circuit 1 becomes independent of the number of simultaneously driven piezoelectric actuators 23, thereby waveform distortion of the driving signal VD supplied to the piezoelectric actuator 23 can be prevented independently of the number of the nozzles (i.e. the number of piezoelectric actuators 23).

The current amplification circuit 22 can be operated by very small current supplied from the voltage amplification circuit 12, therefore the voltage amplification circuit 12 is only required to supply very small current independently of the number of the nozzles (therefore, the voltage amplification circuit 12 is not required to have the current amplification function). Therefore, heat emission and circuit scale of the common waveform generation circuit 1 can be made small.

Each multiplexer 21 is generally composed of transfer gates each of which is composed of MOSFETs. Current which is supplied from the common waveform generation circuit 1 and passes through the MOSFET of the transfer gate is very small, therefore, the multiplexers 21-1~21-*n* and the current amplification circuits 22-1~22-*n* can be implemented with small circuit scales. Therefore, the multiplexers 21-1~21-*n* and the current amplification circuits 22-1~22-*n* can be integrated onto an IC with a high degree of integration.

In the voltage amplification circuit 12, part of the output of the voltage amplification circuit 12 is returned by the feedback circuit 670 to the differential amplification circuit 610 as the feedback voltage (negative feedback). The negative feedback is conducted after executing phase compensation by use of the phase lead circuit 67 composed of the resistor R671 and the capacitor C2. The differential amplification circuit 610 amplifies the input voltage Vin (waveform) supplied from the waveform generation circuit 11 based on the comparison between the input voltage Vin and the feedback voltage. The voltage amplification circuit 12 is also provided with the impedance conversion circuit 660 for driving the circuit between the voltage amplification circuit 12 and the multiplexers 21-1~21-*n* with low output impedance. By such composition of the voltage amplification circuit 12, stable and distortion-free voltage amplification is realized without ill effects of circuits of following stages up to a high frequency range.

Although the input impedance of the current amplification circuit 22 is high, due to the capacitance between the gates and sources of the MOSFETs, the input impedance of the current amplification circuit 22 decreases as the frequency of the driving signal VD gets high. Therefore, the voltage amplification circuit 12 is provided with the impedance conversion circuit 660 and the (negative) feedback circuit 670 for decreasing its output impedance.

By such composition of the ink jet printing head driving device, voltage of waveforms having high slew rates (such as the waveform for the discharge of small ink drops) can be amplified precisely and distortion-free driving signals can be supplied to the piezoelectric actuators 23-1~23-*n*, thereby the variations in the discharged ink drop size and the printed ink dot size can be reduced and high quality printing can be realized.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A driving device for an ink jet printing head that discharges ink drops from its N (N=1,2,3, . . . ) nozzles, each nozzle having a corresponding pressure generation chamber filled with ink, by changing a volume of said corresponding pressure generation chamber, comprising:

a waveform generation means for generating at least one type of waveform;

a voltage identification means corresponding to each of at least one type of waveform for amplifying a voltage level of a respective waveform generated by the waveform generation means and thereby outputting a driving signal;

N selective transition means corresponding to the N nozzles, each of which is for selectively transmitting a driving signal supplied from the voltage amplification means;

N current amplification means corresponding to the N selective transition means, each for amplifying a current level of the driving signal that has passed the corresponding selective transition means, and for supplying a current-amplified driving signal to a corresponding piezoelectric actuator so that the volume of the corresponding pressure generation chamber will be changed and ink drops discharged will be conducted from one of said N nozzles according to the current-amplified driving signal; and wherein a number of voltage amplification means is not equal to N, wherein the voltage amplification means includes an impedance conversion circuit for reducing the output impedance of a voltage amplification means as its output stage for outputting the driving signal, wherein the voltage amplification means further includes:

a feedback circuit which returns a part of the driving signal outputted by the voltage amplification means as a feedback voltage; and a differential amplification circuit which performs a comparison of the waveform supplied from the waveform generation means with the feedback voltage supplied from the feedback circuit and amplifies the waveform according to a result of the comparison, wherein the feedback circuit includes:

a phase lead circuit which is composed of a first resistor and a first capacitor connected in parallel; and a second resistor which is connected to an output side of the phase feed circuit to be grounded, and wherein an output of the impedance conversion circuit is supplied to the phase lead circuit of the feedback circuit.

2. A driving device for an ink jet printing head that discharges ink drops from its N (N=1,2,3, . . . ) nozzles, each nozzle having a corresponding pressure generation chamber filled with ink, by changing the volume of said pressure generation chamber filled with ink, by changing the volume of said corresponding pressure generation chamber, comprising:

a waveform generation means for generating at least one type of waveform;

a voltage amplification means corresponding to each of the at least one type of waveform for amplifying a voltage level of a respective waveform generated by the waveform generation means and thereby outputting a driving signal;

N selective transition means corresponding to the N nozzles, each of which is for selectively transmitting a driving signal supplied from the voltage amplification means;

N current amplification means corresponding to the N selective transmission means, each amplifying a current level of a driving signal that has passed the corresponding selective transition means, and for supplying a current-amplified driving signal to a corresponding piezoelectric actuator so that the volume of the corresponding pressure generation chamber will be changed and an ink drop discharge will be conducted from one of said N nozzles according to current-amplified driving signal; and wherein a number of voltage amplification means is not equal to N, and wherein the current amplification means includes:

a first bias circuit for converting the driving signal that passed the corresponding selective transition means to a bias voltage; and a first source follower having a single-ended push-pull (SEPP) structure, and wherein the first bias circuit of the current amplification means includes:

a first resistor and a second resistor which are connected in series and which receive the driving signal from the corresponding selective transmission means at a wiring therebetween;

a first constant-current circuit having an input terminal that is supplied with a power supply voltage and having an output terminal that is connected to an end of the first resistor opposite to the second resistor; and a second constant-current circuit having an input terminal that is connected to an end of the second resistor opposite to the first resistor and having an output terminal that is grounded.

3. A driving device for an ink jet printing head as claimed in claim 2, wherein the first source follower of the current amplification means includes:

a first N-MOSFET having a drain that is supplied with the power supply voltage and having a gate that is connected to the output terminal of the first constant-current circuit; and a first P-MOSFET having a source that is connected to a source of the first N-MOSFET and having a gate that is connected to the input terminal of the second constant-current circuit and having a drain that is grounded, and wherein an output of the current amplification means is taken from a wiring between the source of the first N-MOSFET and the source of the first P-MOSFET.

4. A driving device for an ink jet printing head that discharges ink drops from its N (N=1,2,3, . . . ) nozzles, each nozzle having a corresponding pressure generation chamber filled with ink, by changing the volume of said pressure generation chamber filled with ink, by changing the volume of said corresponding pressure generation chamber, comprising:

a waveform generation means for generating at least one type of waveform;

a voltage amplification means corresponding to each of the at least one type of waveform for amplifying a voltage level of a respective waveform generated by the waveform generation means and thereby outputting a driving signal;

N selective transition means corresponding to the N nozzles, each of which is for selectively transmitting a driving signal supplied from the voltage amplification means;

N current amplification means corresponding to the N selective transmission means, each amplifying a current level of a driving signal that has passed the corresponding selective transition means, and for supplying a current-amplified driving signal to a corresponding piezoelectric actuator so that the volume of the corresponding pressure generation chamber will be changed and an ink drop discharge will be conducted from one of said N nozzles according to current-amplified driving signal; and wherein a number of voltage amplification means is not equal to N, and wherein the current amplification means includes:

a first bias circuit for converting the driving signal that passed the corresponding selective transition means to a bias voltage; and a first source follower having a single-ended push-pull (SEPP) structure, and, wherein:

the first source follower of the current amplification means includes two MOSFETs, and the first bias circuit of the current amplification means includes two MOSFETs corresponding to the two MOSFETs of the first source follower, and each MOSFET of the first source follower has a polarity that is opposite to a polarity of the corresponding MOSFET of the first bias circuit.

5. A driving device for an ink jet printing head that discharges ink drops from its N (N=1,2,3, . . . ) nozzles, each nozzle having a corresponding pressure generation chamber filled with ink, by changing the volume of said pressure generation chamber filled with ink, by changing the volume of said corresponding pressure generation chamber, comprising:

a waveform generation means for generating at least one type of waveform;

a voltage amplification means corresponding to each of the at least one type of waveform for amplifying a voltage level of a respective waveform generated by the waveform generation means and thereby outputting a driving signal;

N selective transition means corresponding to the N nozzles, each of which is for selectively transmitting a driving signal supplied from the voltage amplification means;

N current amplification means corresponding to the N selective transmission means, each amplifying a current level of a driving signal that has passed the corresponding selective transition means, and for supplying a current-amplified driving signal to a corresponding piezoelectric actuator so that the volume of the corresponding pressure generation chamber will be changed and an ink drop discharge will be conducted from one of said N nozzles according to current-amplified driving signal; and wherein a number of voltage amplification means is not equal to N, and wherein the current amplification means includes:

a first bias circuit for converting the driving signal that passed the corresponding selective transition means to a bias voltage; and a first source follower having a single-ended push-pull (SEPP) structure, wherein the first bias circuit of the current amplification means includes:

a first P-MOSFET having a gate that is supplied with the guidance signal that passed the selected transition means and having a drain that is grounded;

a first N-MOSFET having a gate that is supplied with a driving signal that passed the selected transition means and having a drain that is supplied with a power supply voltage;

a first resistor having a first end that is supplied with a power supply voltage and having a second end that is connected to a source of the first P-MOSFET; and a second resistor having a first end that is connected to a source of the first N-MOSFET and having a second end that is grounded, wherein the first source follower of the current amplification means includes:

a second N-MOSFET having a drain that is supplied with the power supply voltage and having a gate that is connected to the source of the first P-MOSFET; and a second P-MOSFET having a source that is connected to a source of the second N-MOSFET and having a gate that is connected to the source of the first N-MOSFET and having a drain that is grounded, and wherein an output of the current amplification means is taken from a wiring between the source of the second N-MOSFET and the source of the second P-MOSFET.

6. A driving device for an ink jet printing head that discharges ink drops from its N (N=1,2,3, . . . ) nozzles, each nozzle having a corresponding pressure generation chamber filled with ink, by changing the volume of said pressure generation chamber filled with ink, by changing the volume of said corresponding pressure generation chamber, comprising:

a waveform generation means for generating at least one type of waveform;

a voltage amplification means corresponding to each of the at least one type of waveform for amplifying a voltage level of a respective waveform generated by the waveform generation means and thereby outputting a driving signal;

N selective transition means corresponding to the N nozzles, each of which is for selectively transmitting a driving signal supplied from the voltage amplification means;

N current amplification means corresponding to the N selective transmission means, each amplifying a current level of a driving signal that has passed the corresponding selective transition means, and for supplying a current-amplified driving signal to a corresponding piezoelectric actuator so that the volume of the corresponding pressure generation chamber will be changed and an ink drop discharge will be conducted from one of said N nozzles according to current-amplified driving signal; and wherein a number of voltage amplification means is not equal to N, wherein the first current amplification means includes:

a first constant-current circuit; and a first source follower having a single-ended push-pull (SEPP) structure, wherein the first constant-current circuit has a current mirror structure, wherein the current amplification means includes:

a first P-MOSFET having a gate that is supplied with the driving signal that passed the selective transmission means;

a first resistor having a first end that is supplied with a power supply voltage and having a second end that is connected to a source of the first P-MOSFET;

a first N-MOSFET having a drain that is supplied with the power supply voltage and having a gate that is connected to the source of the first P-MOSFET;

a second N-MOSFET having a drain that is connected to a drain of the first P-MOSFET;

a third N-MOSFET having a drain that is connected to a source of the first N-MOSFET and having a gate that is connected to a gate of the second N-MOSFET and the drain of the first P-MOSFET;

a second resistor having a first end that is connected to a source of the second N-MOSFET and having a second end that is grounded; and a third resistor having a first end that is connected to a source of the third N-MOSFET and having a second end that is grounded, and wherein an output of the current amplification means is taken from a wiring between the source of the first N-MOSFET and the drain of the third N-MOSFET.

7. A driving method for an ink jet printing head that discharges ink drops from its N (N=1, 2, 3, . . . ) nozzles by changing the volumes of pressure generation chambers filled with ink, comprising:

a waveform generation step in which at least one waveform is generated;

a voltage amplification step in which a voltage level of the at least one waveform generated in the waveform generation step is amplified and thereby a driving signal is obtained;

a selective transmission step in which the driving signal obtained in the voltage amplification step is selectively transmitted by N selective transmission means corresponding to the N nozzles individually and simultaneously;

a current amplification step in which a current level of each driving signal that passed each of the N selective transmission means in the selective transmission step is amplified by each of corresponding N current amplification means individually to be supplied to a corresponding piezoelectric actuator so that a volume of one of said pressure generation chambers will be changed and an ink drop discharge will be conducted from one of said N nozzles according to the current-amplified driving signal; and wherein a number of waveforms generated in the waveform generation step is not equal to N;

wherein the voltage amplification step is conducted employing an impedance conversion circuit for reducing an output impedance as the output stage of the voltage amplification means;

wherein the voltage amplification step is conducted further employing:

a feedback circuit which returns a part of the driving signal obtained in the voltage amplification step as a feedback voltage; and a differential amplification circuit which performs a comparison of the waveform generated in the waveform generation step with the feedback voltage supplied from the feedback circuit and amplifies the waveform according to the result of the comparison;

wherein the feedback circuit includes:

a phase lead circuit which is composed of a first resistor and a first capacitor connected in parallel; and a second resistor which is connected to an output side of the phase lead circuit to be grounded; and wherein an output of the impedance conversion circuit is supplied to the phase lead circuit of the feedback circuit.

8. A driving method for an ink jet printing head that discharges ink drops from its N (N=1, 2, 3, . . . ) nozzles by changing the volumes of pressure generation chambers filled with ink, comprising:

a waveform generation step in which at least one waveform is generated;

a voltage amplification step in which a voltage level of the at least one waveform generated in the waveform generation step is amplified and thereby a driving signal is obtained;

a selective transmission step in which the driving signal obtained in the voltage amplification step is selectively transmitted by N selective transmission means corresponding to the N nozzles individually and simultaneously;

a current amplification step in which a current level of each driving signal that passed each of the N selective transmission means in the selective transmission step is amplified by each of corresponding N current amplification means individually to be supplied to a corresponding piezoelectric actuator so that a volume of one of said pressure generation chambers will be changed and an ink drop discharge will be conducted from one of said N nozzles according to the current-amplified driving signal; and wherein a number of waveforms generated in the waveform generation step is not equal to N;

wherein the current amplification means which is used for the current amplification step includes:

a first bias circuit for converting the driving signal that passed the corresponding selective transmission means in the selective transmission step to a bias voltage; and a first source follower having a single-ended push-pull (SEPP) structure; and wherein the second bias circuit of the current amplification means includes:

a first resistor and a second resistor which are connected in series and which receive the driving signal from the corresponding selective transmission means at a wiring therebetween;

a first constant-current circuit having an input terminal that is supplied with a power supply voltage and having an output terminal that is connected to an end of the first resistor opposite to the second resistor; and a second constant-current circuit having an input terminal that is connected to an end of the second resistor opposite to the first resistor and having an output terminal that is grounded.

9. A driving method for an ink jet printing head as claimed in claim 8, wherein the first source follower of the current amplification means includes:

a first N-MOSFET having a drain that is supplied with the power supply voltage and having a gate that is connected to the output terminal of the first constant-current circuit; and a first P-MOSFET having a source that is connected to a source of the first N-MOSFET and having a gate that is connected to the input terminal of the second constant-current circuit and having a drain that is grounded, and wherein an output of the current amplification means is taken from a wiring between the source of the first N-MOSFET and the source of the first P-MOSFET.

10. A driving method for an ink jet printing head that discharges ink drops from its N (N=1, 2, 3, . . . ) nozzles by changing the volumes of pressure generation chambers filled with ink, comprising:

a waveform generation step in which at least one waveform is generated;

a voltage amplification step in which a voltage level of the at least one waveform generated in the waveform generation step is amplified and thereby a driving signal is obtained;

a selective transmission step in which the driving signal obtained in the voltage amplification step is selectively transmitted by N selective transmission means corresponding to the N nozzles individually and simultaneously;

a current amplification step in which a current level of each driving signal that passed each of the N selective transmission means in the selective transmission step is amplified by each of corresponding N current amplification means individually to be supplied to a corresponding piezoelectric actuator so that a volume of one of said pressure generation chambers will be changed and an ink drop discharge will be conducted from one of said N nozzles according to the current-amplified driving signal; and wherein a number of waveforms generated in the waveform generation step is not equal to N;

wherein the current amplification means which is used for the current amplification step includes:

a first bias circuit for converting the driving signal that passed the corresponding selective transmission means in the selective transmission step to a bias voltage; and a first source follower having a single-ended push-pull (SEPP) structure; and wherein:

the first source follower of the current amplification means includes two MOSFETs, and the first bias circuit of the current amplification means includes two MOSFETs corresponding to the two MOSFETs of the first source follower, and each MOSFET of the first source follower has a polarity that is opposite to a polarity of the corresponding MOSFET of the first bias circuit.

11. A driving method for an ink jet printing head that discharges ink drops from its N (N=1, 2, 3, . . . ) nozzles by changing the volumes of pressure generation chambers filled with ink, comprising:

a waveform generation step in which at least one waveform is generated;

a voltage amplification step in which a voltage level of the at least one waveform generated in the waveform generation step is amplified and thereby a driving signal is obtained;

a selective transmission step in which the driving signal obtained in the voltage amplification step is selectively transmitted by N selective transmission means corresponding to the N nozzles individually and simultaneously;

a current amplification step in which a current level of each driving signal that passed each of the N selective transmission means in the selective transmission step is amplified by each of corresponding N current amplification means individually to be supplied to a corresponding piezoelectric actuator so that a volume of one of said pressure generation chambers will be changed and an ink drop discharge will be conducted from one of said N nozzles according to the current-amplified driving signal; and wherein a number of waveforms generated in the waveform generation step is not equal to N;

wherein the current amplification means which is used for the current amplification step includes:

a first bias circuit for converting the driving signal that passed the corresponding selective transmission means in the selective transmission step to a bias voltage; and a first source follower having a single-ended push-pull (SEPP) structure; and wherein the second bias circuit of the current amplification means includes:

a first P-MOSFET having a gate that is supplied with the driving signal that passed the selective transmission means in the selective transmission step and having a drain that is grounded;

a first N-MOSFET having a gate that is supplied with the driving signal that passed the selective transmission means in the selective transmission step and having a drain that is supplied with a power supply voltage;

a first resistor having a first end that is supplied with the power supply voltage and having a second end that is connected to a source of the first P-MOSFET; and a second resistor having a first end that is connected to a source of the first N-MOSFET and having a second end that is grounded; and wherein the first source follower of the current amplification means includes:

a second N-MOSFET having a drain that is supplied with the power supply voltage and having a gate that is connected to the source of the first P-MOSFET; and a second P-MOSFET having a source that is connected to a source of the second N-MOSFET and having a gate that is connected to the source of the first N-MOSFET and having a drain that is grounded, and wherein an output of the current amplification means is taken from a wiring between the source of the second N-MOSFET and the source of the second P-MOSFET.

12. A driving method for an ink jet printing head that discharges ink drops from its N (N=1, 2, 3, . . . ) nozzles by changing the volumes of pressure generation chambers filled with ink, comprising:

a waveform generation step in which at least one waveform is generated;

a voltage amplification step in which a voltage level of the at least one waveform generated in the waveform generation step is amplified and thereby a driving signal is obtained;

a selective transmission step in which the driving signal obtained in the voltage amplification step is selectively transmitted by N selective transmission means corresponding to the N nozzles individually and simultaneously;

a current amplification step in which a current level of each driving signal that passed each of the N selective transmission means in the selective transmission step is amplified by each of corresponding N current amplification means individually to be supplied to a corresponding piezoelectric actuator so that a volume of one of said pressure generation chambers will be changed and an ink drop discharge will be conducted from one of said N nozzles according to the current-amplified driving signal; and wherein a number of waveforms generated in the waveform generation step is not equal to N;

wherein the current amplification means which is used for the current amplification step includes:

a first constant-current circuit; and a first source follower having a single-ended push-pull (SEPP) structure; and wherein the first constant-current circuit has a current mirror structure; and wherein the current amplification means includes:

a first P-MOSFET having a gate that is supplied with the driving signal that passed the selective transmission means in the selective transmission step;

a first resistor having a first end that is supplied with a power supply voltage and having a second end that is connected to a source of the first P-MOSFET;

a first N-MOSFET having a drain that is supplied with the power supply voltage and having a gate that is connected to the source of the first P-MOSFET;

a second N-MOSFET having a drain that is connected to a drain of the first P-MOSFET;

a third N-MOSFET having a drain that is connected to a source of the first N-MOSFET and having a gate that is connected to a gate of the second N-MOSFET and the drain of the first P-MOSFET;

a second resistor having a first end that is connected to a source of the second N-MOSFET and having a second end that is grounded; and a third resistor having a first end that is connected to a source of the third N-MOSFET and having a second end that is grounded, and wherein an output of the current amplification means is taken from a wiring between the source of the first N-MOSFET and the drain of the third N-MOSFET.

* * * * *